US007237858B2

(12) United States Patent
Igarashi

(10) Patent No.: US 7,237,858 B2
(45) Date of Patent: Jul. 3, 2007

(54) PRINTING APPARATUS, PRINTING METHOD, STORAGE MEDIUM, AND COMPUTER SYSTEM

(75) Inventor: Hitoshi Igarashi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 311 days.

(21) Appl. No.: 10/939,886

(22) Filed: Sep. 14, 2004

(65) Prior Publication Data

US 2005/0078134 A1 Apr. 14, 2005

Related U.S. Application Data

(63) Continuation-in-part of application No. 10/486,637, filed on Dec. 1, 2004.

(51) Int. Cl.
*B41J 25/308* (2006.01)

(52) U.S. Cl. ..... 347/8; 347/16; 347/37

(58) Field of Classification Search ..... None
See application file for complete search history.

(56) References Cited

U.S. PATENT DOCUMENTS

| | | | | |
|---|---|---|---|---|
| 5,873,663 | A * | 2/1999 | Yokoi et al. | 400/279 |
| 6,260,945 | B1 | 7/2001 | Niikura | |
| 6,419,338 | B1 | 7/2002 | Ikeda | |
| 6,471,315 | B1 * | 10/2002 | Kurata | 347/8 |
| 6,910,752 | B2 | 6/2005 | Shoji | |
| 2001/0028375 | A1 | 10/2001 | Ohtani et al. | |

FOREIGN PATENT DOCUMENTS

| | | | |
|---|---|---|---|
| EP | 095928 | A2 | 6/1999 |
| JP | 52-108732 | B | 9/1977 |
| JP | 53-33419 | A | 3/1978 |
| JP | 55-85984 | A | 6/1980 |
| JP | 57-4779 | A | 1/1982 |
| JP | 57-135184 | A | 8/1982 |
| JP | 59-54571 | A | 3/1984 |
| JP | 64-85773 | A | 3/1989 |
| JP | 01-301261 | A | 12/1989 |
| JP | 03-58919 | A | 3/1991 |
| JP | 03-817892 | A1 | 11/1991 |
| JP | 04-135873 | A | 5/1992 |
| JP | 04-189158 | A | 7/1992 |
| JP | 05-24264 | A | 2/1993 |
| JP | 05-155009 | B1 | 6/1993 |
| JP | 05-177878 | A | 7/1993 |
| JP | 06-143724 | | 5/1994 |
| JP | 07-25103 | A | 1/1995 |
| JP | 08-99439 | A | 4/1996 |
| JP | 09-1863 | A | 1/1997 |
| JP | 10-100398 | A | 4/1998 |

(Continued)

OTHER PUBLICATIONS

Chinese Office Action Dated Mar. 17, 2006.

*Primary Examiner*—Thinh Nguyen
(74) *Attorney, Agent, or Firm*—Sughrue Mion, PLLC

(57) ABSTRACT

A printing apparatus for printing on a medium to be printed includes an ink ejection section for intermittently ejecting ink while moving, wherein the printing apparatus detects a distance from the ink ejection section to the medium to be printed, and controls a timing of intermittent ejection of the ink from the ink ejection section based on the distance that has been detected. With such a printing apparatus, the timing at which ink is ejected can be controlled taking into account the distance from the ink ejection section to the medium to be printed.

15 Claims, 24 Drawing Sheets

FOREIGN PATENT DOCUMENTS

| | | | |
|---|---|---|---|
| JP | 11-91554 | A | 4/1999 |
| JP | 11-179965 | A | 7/1999 |
| JP | 11-221910 | A | 8/1999 |
| JP | 11-240146 | A | 9/1999 |
| JP | 11-245470 | A | 9/1999 |
| JP | 11-277808 | A | 10/1999 |
| JP | 11-334149 | A | 12/1999 |
| JP | 2000-94751 | A | 4/2000 |
| JP | 2000-289253 | A | 10/2000 |
| JP | 2001-96733 | A | 4/2001 |
| JP | 2001-146002 | A | 5/2001 |
| JP | 2001-146040 | A | 5/2001 |
| JP | 2002-2046 | A | 1/2002 |

* cited by examiner

PG table

| position | detection result | |
|---|---|---|
| pixel 1 | PG1 | → black ink nozzle group (K) |
| pixel 2 | PG2 | → cyan ink nozzle group (C) |
| pixel 3 | PG3 | → magenta ink nozzle group (M) |
| pixel 4 | PG4 | → yellow ink nozzle group (Y) |
| pixel 5 | — | |
| pixel 6 | — | |
| ⋮ | ⋮ | |

FIG. 20A

PG table

| position | detection result | |
|---|---|---|
| pixel 1 | PG1 | |
| pixel 2 | PG2 | → black ink nozzle group (K) |
| pixel 3 | PG3 | → cyan ink nozzle group (C) |
| pixel 4 | PG4 | → magenta ink nozzle group (M) |
| pixel 5 | PG5 | → yellow ink nozzle group (Y) |
| pixel 6 | — | |
| ⋮ | ⋮ | |

FIG. 20B

PRINTING APPARATUS, PRINTING METHOD, STORAGE MEDIUM, AND COMPUTER SYSTEM

CROSS-REFERENCE TO RELATED APPLICATIONS

This application is a continuation-in-part of application Ser. No. 10/486,637 filed on Dec. 1, 2004, the disclosure of which is incorporated herein by reference. The present application claims priority upon Japanese Patent Application No. 2002-070874 filed on Mar. 14, 2002, Japanese Patent Application No. 2002-070875 filed on Mar. 14, 2002, Japanese Patent Application No. 2002-070876 filed on Mar. 14, 2002, Japanese Patent Application No. 2002-070877 filed on Mar. 14, 2002, and Japanese Patent Application No. 2004-194050 filed on Jun. 30, 2004, which are herein incorporated by reference.

BACKGROUND OF THE INVENTION

1. Field of the Invention

The present invention relates to printing apparatuses, printing methods, programs, storage media, and computer systems.

2. Description of the Related Art

Inkjet printers that perform printing by intermittently ejecting ink are known as printing apparatuses for printing images onto various types of media to be printed, including paper, cloth, and film.

With inkjet printers, ink is ejected as nozzles for ejecting ink are moved. For that reason, due to the law of inertia, the droplets of ink that are ejected travel from the nozzles to the medium to be printed as they move in the moving direction of the nozzles at the moving velocity of the nozzles. Consequently, the ink droplets land on the paper at positions that are shifted in the moving direction of the nozzles from the positions of the nozzles when the ink droplets are ejected.

Accordingly, with conventional inkjet printers, printing is carried out taking into account the shift in landing positions based on the moving velocity of the nozzle.

(1) The shift in the landing position caused by movement of the nozzles, however, is related not only to the moving velocity of the nozzles but also to the distance from the nozzles to the medium to be printed. For that reason, the amount that the landing position is shifted due to the movement of the nozzles also changes when the distance from the nozzles to the medium to be printed changes due to the thickness of the paper or curvature in the paper, for example.

Accordingly, to make the ink droplets land in correct positions, it is an object of a first invention to control the timing at which ink droplets are ejected, taking into account the distance from the nozzles to the medium to be printed.

(2) Also, if the timing of ink ejection were to be set at an earlier timing or a delayed timing with respect to a reference timing for ink ejection in accordance with the velocity at which the nozzles are moved, then calculations would become complicated. Furthermore, when the timing of ink ejection is at a fast timing that exceeds the performance of the head, printing can no longer be carried out accurately.

Accordingly, to make the ink droplets land correctly, a second invention makes the maximum velocity of the target moving velocity slower than a predetermined reference velocity.

(3) Also, a temporal lag between when the moving velocity of the nozzles is detected and the ink is ejected may result in a difference between the detected moving velocity of the nozzles and the moving velocity of the nozzles when ejecting ink. Consequently, even if variation in the landing positions is taken into account based on the detected moving velocity of the nozzles, ink does not land in correct positions when the moving velocity of the nozzles when ejecting ink is different from the detected moving velocity of the nozzles.

For example, if printing is carried out when the nozzles are accelerating or decelerating, then when there is a temporal lag between when the moving velocity of the nozzles is detected and when the ink is ejected, there would be a difference between the detected moving velocity of the nozzles and the moving velocity of the nozzles when ink is ejected. Thus, the ink will not land at correct positions when the nozzles are accelerating or decelerating simply by controlling the timing at which ink is ejected based on the detected moving velocity of nozzles, as is the case with conventional inkjet printers.

Accordingly, to make the ink land at correct positions, it is an object of a third invention to control the timing at which the ink droplets are ejected in accordance with the degree of acceleration of the nozzles.

(4) Also, when the detected moving velocity of the nozzles includes error, then the ink will land on the medium to be printed at positions shifted from the correct positions if the shift in the position where the ink droplets land is calculated based on that moving velocity including error.

In particular, when the moving velocity of the nozzles is detected based on the output of an encoder, the velocity is detected in a stepwise manner if the encoder has low resolution, and thus there is large error in the detected velocity. Moreover, if consideration to the shift in landing position of the ink droplets is given based on the detected moving velocity including large detection error, the ink will land on the medium to be printed shifted from the correct positions.

Accordingly, to make the ink land in correct positions, it is an object of a fourth invention to control the timing at which the ink droplets are ejected based on the results of a plurality of detections.

SUMMARY OF THE INVENTION

In one aspect of the present invention, a printing apparatus for printing on a medium to be printed includes an ink ejection section for intermittently ejecting ink while moving, wherein the printing apparatus: detects a distance from the ink ejection section to the medium to be printed; and controls a timing of intermittent ejection of the ink from the ink ejection section based on the distance that has been detected.

Further, in another aspect of the present invention, a printing apparatus for printing on a medium to be printed includes an ink ejection section for ejecting ink while moving, wherein the printing apparatus:

sets a maximum value of a target velocity of the ink ejection section slower than a reference velocity;

moves the ink ejection section according to the target velocity; and when a timing of ejection of ink for when the ink ejection section moves at the reference velocity is regarded as a reference timing, ejects the ink at a timing that is delayed from the reference timing based on a moving velocity of the ink ejection section and the reference velocity.

Further, in another aspect of the present invention, a printing apparatus for printing on a medium to be printed includes an ink ejection section for intermittently ejecting ink while moving, wherein the printing apparatus controls a timing of intermittent ejection of the ink from the ink ejection section according to an acceleration of the ink ejection section that moves.

Further, in another aspect of the present invention, a printing apparatus for printing on a medium to be printed includes an ink ejection section for intermittently ejecting ink while moving, wherein the printing apparatus:

sequentially detects a velocity at which the ink ejection section moves; and controls a timing of intermittent ejection of the ink from the ink ejection section based on a plurality of velocities that have been detected.

It should be noted that that present invention may also be understood from other standpoints. Also, other features of the present invention will be made clear through the appended drawings and the description of the present invention.

BRIEF DESCRIPTION OF THE DRAWINGS

FIG. 20A is an explanatory diagram showing a PG table for the state shown in FIG. 19B, and FIG. 20B is an explanatory diagram showing a PG table for a state in which the carriage has been moved from the state shown in FIG. 19B to the left by one pixel.

DETAILED DESCRIPTION OF THE INVENTION

===Overview of the Disclosure===

Figure 1:
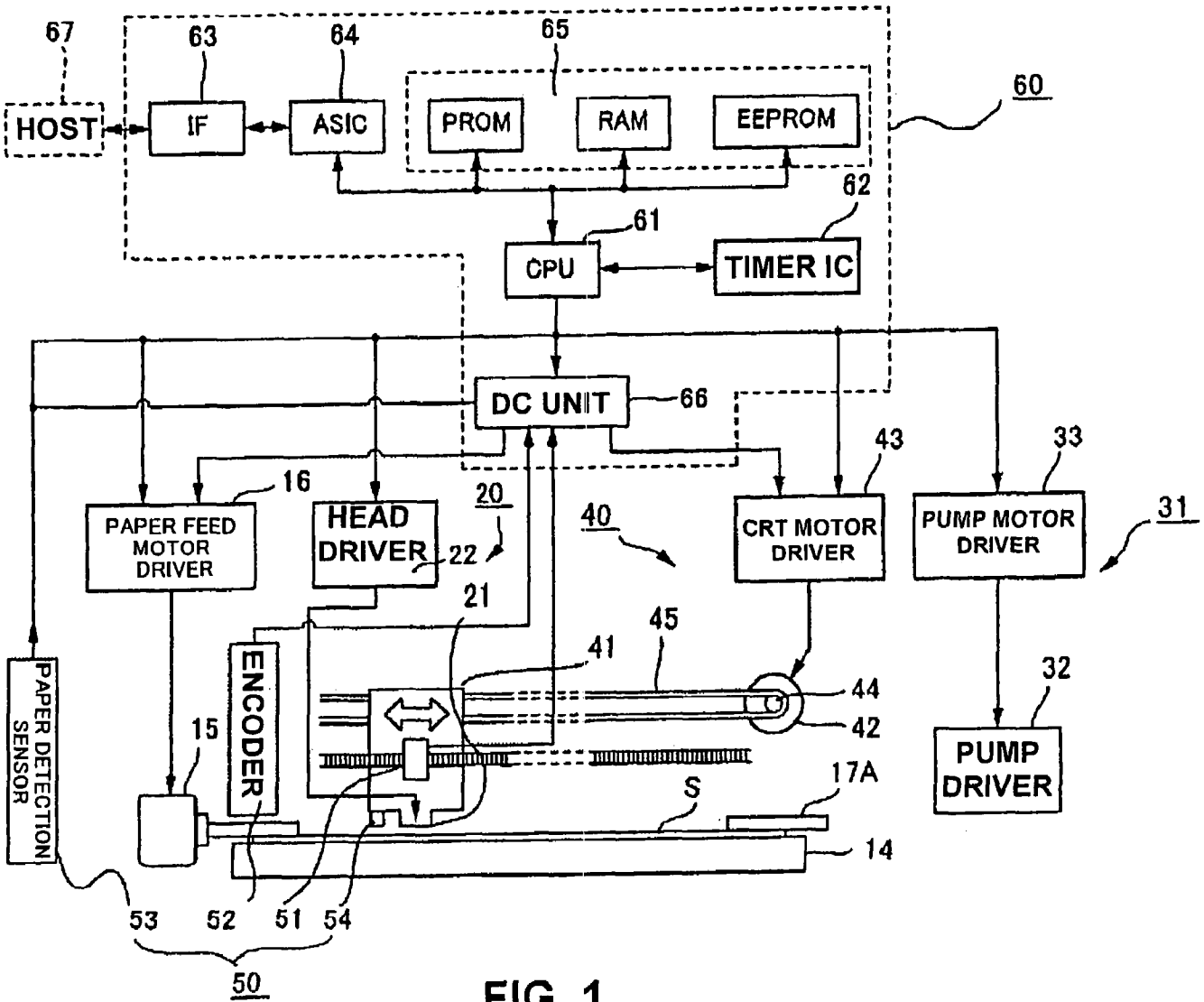
FIG. 1 is an explanatory diagram of the overall configuration of an inkjet printer of the present embodiment.

Through the below disclosure at least the following matters will be made clear.

A printing apparatus for printing on a medium to be printed, comprises an ink ejection section for intermittently ejecting ink while moving, wherein the printing apparatus:

detects a distance from the ink ejection section to the medium to be printed; and controls a timing of intermittent ejection of the ink from the ink ejection section based on the distance that has been detected.

With this printing apparatus, the timing at which ink is ejected can be controlled taking into account the distance from the ink ejection section to the medium to be printed.

In the printing apparatus, it is preferable that when a velocity at which the ink ejection section moves is slower than a velocity serving as a reference, the ink is ejected at a timing that is delayed compared to the timing of ejection of the ink for when the ink ejection section is moving at the velocity serving as the reference. With this printing apparatus, when the velocity at which the ink ejection moves is slow, it is possible to delay the timing of the ejection of ink droplets, taking into account the distance from the nozzles to the medium to be printed.

In the printing apparatus, it is preferable that the slower the velocity at which the ink ejection section moves, the more the timing at which the ink is ejected is delayed. With this printing apparatus, the timing at which ink is ejected can be delayed in accordance with the velocity at which the ink ejection section moves.

In the printing apparatus, it is preferable that the smaller the distance is, the more the timing at which the ink is ejected is delayed. With this printing apparatus, the timing at which ink is ejected can be delayed in accordance with the distance form the ink ejection section to the medium to be printed.

In the printing apparatus, it is preferable that the distance is detected based on information about a type of the medium to be printed or on information about a tray accommodating the medium to be printed. With this printing apparatus, the distance can be detected from the thickness of the medium to be printed.

In the printing apparatus, it is preferable that the distance is detected based on information about the medium to be printed that is input by a user. With this printing apparatus, the distance can be detected based on a medium to be printed that is specified by the user.

In the printing apparatus, it is preferable that the distance is detected based on a result of a measurement of the distance to the medium to be printed. With this printing apparatus, the distance can be detected from the results of the measurement.

In the printing apparatus, it is preferable that the detection of the distance is performed at a plurality of positions in a direction in which the ink ejection section moves; and the timing of ejection of the ink is controlled for each area provided in a scanning direction. With this printing apparatus, printing can be carried out with high precision even if the distance changes in the direction in which the ink ejection section moves.

In the printing apparatus, it is preferable that a plurality of the ink ejection sections are provided in a direction in which the medium to be printed is carried; the detection of the distance is performed at a plurality of positions in the direction in which the medium to be printed is carried; and the timing of ejection of the ink is controlled for each of the ink ejection sections. With this printing apparatus, printing can be carried out with high precision even if the distance changes in the direction in which the medium to be printed is carried.

In the printing apparatus, it is preferable that a plurality of the ink ejecting sections are provided at different positions in the direction in which the ink ejection sections move; the detection of the distance is performed at different positions in the direction in which the ink ejection sections move; and the timing of ejection of the ink for each of the ink ejection sections is controlled based on the distance that has been detected respectively at different positions.

In the printing apparatus, it is preferable that a velocity of the ink that is ejected is detected; and the timing of ejection of the ink from the ink ejection section is controlled based on the velocity of the ink that has been detected and the distance that has been detected. With this printing apparatus, the timing at which ink is ejected can be controlled in accordance with the velocity at which ink is ejected and the distance.

In the printing apparatus, it is preferable that the velocity of the ink is detected based on an amount of the ink that is ejected. With this printing apparatus, the timing at which ink is ejected can be controlled in accordance with the amount of ink that is ejected.

In the printing apparatus, it is preferable that the velocity of the ink is detected based on a temperature. With this printing apparatus, the timing at which ink is ejected can be controlled according to the temperature.

In the printing apparatus, it is preferable that the velocity of the ink is detected based on a print mode. With this printing apparatus, the timing at which ink is ejected can be controlled in accordance with the print mode.

In the printing apparatus, it is preferable that the faster the velocity of the ink that is ejected is, the more the timing at which the ink is ejected is delayed. With this printing apparatus, the timing at which ink is ejected can be delayed in accordance with the velocity at which ink is ejected.

In addition to these printing apparatuses, printing methods, programs, storage media, and computer systems are also made clear.

A printing apparatus for printing on a medium to be printed, comprises an ink ejection section for ejecting ink while moving, wherein the printing apparatus:

sets a maximum value of a target velocity of the ink ejection section slower than a reference velocity;

moves the ink ejection section according to the target velocity; and when a timing of ejection of ink for when the ink ejection section moves at the reference velocity is regarded as a reference timing, ejects the ink at a timing that is delayed from the reference timing based on a moving velocity of the ink ejection section and the reference velocity.

With this printing apparatus, the timing of ink ejection can be kept from becoming faster than the timing serving as the reference for the ejection of ink due to the velocity at which the nozzles are moved.

In the printing apparatus, it is preferable that the reference velocity is set based on a period at which the ink ejection section can eject ink. It is also preferable that the reference velocity is set based on a spacing between dots formed on the medium to be printed. With these printing apparatuses, the timing of ink ejection can be kept from becoming a fast timing that exceeds the capacity of the head.

In the printing apparatus, it is preferable that the slower the moving velocity of the ink ejection section is, the more the timing at which the ink is ejected is delayed. With this printing apparatus, the ink can be made to land at correct positions.

In the printing apparatus, it is preferable that the moving velocity of the ink ejection section is detected by an encoder. With this printing apparatus, the timing of ejection of ink can be controlled based on the results of the detection by the encoder.

In the printing apparatus, it is preferable that control of the timing based on the moving velocity of the ink ejection section and the reference velocity is performed when the ink ejection section is moving with acceleration or deceleration. With this printing apparatus, even if the velocity of the ink ejection section is in a slow state, such as during acceleration or deceleration, the ink can be made to land at correct positions by shifting the timing of the ejection of ink.

In the printing apparatus, it is preferable that the reference velocity is 4 to 6% faster than the maximum value of the target velocity. With this printing apparatus, even if the actual moving velocity of the ink ejection section does not match the target velocity, the timing of ink ejection can be kept from becoming faster than the timing serving as the reference for the ejection of ink.

In the printing apparatus, it is preferable that ink is ejected at the reference timing when the moving velocity of the ink ejection section is faster than the reference velocity. With this printing apparatus, the timing of ink ejection is kept from becoming faster than the timing serving as the reference for the ejection of ink.

In addition to these printing apparatuses, printing methods, programs, storage media, and computer systems are also made clear.

A printing apparatus for printing on a medium to be printed, comprising an ink ejection section for intermittently ejecting ink while moving, wherein the printing apparatus controls a timing of intermittent ejection of the ink from the ink ejection section according to an acceleration of the ink ejection section that moves.

With this printing apparatus, ink can be made to land at correct positions.

In the printing apparatus, it is preferable that the printing apparatus further includes a position detection section for detecting a position of the ink ejection section; and a period of the timing of intermittent ejection of the ink is shorter than a period of detecting the position with the position detection section. With this printing apparatus, ink can be ejected at a shorter spacing than the resolution of the position detection section.

In the printing apparatus, it is preferable that if the acceleration of the ink ejection section that moves is positive, then a period of the timing of intermittent ejection of the ink becomes short; and if the acceleration of the ink ejection section that moves is negative, then the period of the timing of intermittent ejection of the ink becomes long. With this printing apparatus, the timing of printing can be controlled according to the acceleration and the deceleration of the ink ejection section.

In the printing apparatus, it is preferable that the printing apparatus calculates a future velocity of the ink ejection section based on the acceleration of the ink ejection section that moves; and the timing is controlled based on the velocity of the ink ejection section that has been calculated. With this printing apparatus, the timing of the ejection of ink can be controlled based on the velocity when ink is ejected.

In the printing apparatus, it is preferable that the printing apparatus detects a velocity of the ink ejection section; and the printing apparatus calculates the future velocity of the ink ejection section based on the velocity that has been detected. With this printing apparatus, the timing of the ejection of ink can be controlled based on the velocity when ink is ejected.

In the printing apparatus, it is preferable that when the velocity of the ink ejection section that has been calculated is slower than a velocity serving as a reference, the ink ejection section ejects the ink at a timing that is delayed compared to the timing of ejection of the ink for when the ink ejection section is moving at the velocity serving as the reference. It is also preferable that the slower the velocity at which the ink ejection section moves, the more the timing at which the ink is ejected is delayed. With these printing apparatuses, ink can be made to land at correct positions.

In the printing apparatus, it is preferable that the printing apparatus calculates a delay amount of ink ejection based on the velocity of the ink ejection section that has been calculated; and the ink ejection section ejects ink at a timing delayed by the delay amount from a signal that serves as a reference for the timing at which the ink is ejected. With this printing apparatus, ink can be made to land at correct positions.

In addition to these printing apparatuses, printing methods, programs, storage media, and computer systems are also made clear.

A printing apparatus comprises a signal generator for generating a signal that serves as a reference for a timing at which ink is ejected, wherein ink is ejected from an ink ejection section taking the signal as the reference, and wherein the signal is generated according to an acceleration of the ink ejection section.

With this printing apparatus, reference signals can be generated at correct positions.

In the printing apparatus, it is preferable that the ink ejection section ejects ink at a timing that is delayed according to the acceleration of the ink ejection section, taking the signal as the reference. With this printing apparatus, ink can be made to land at correct positions.

A printing apparatus for printing on a medium to be printed, comprising an ink ejection section for intermittently ejecting ink while moving, wherein the printing apparatus:

sequentially detects a velocity at which the ink ejection section moves; and controls a timing of intermittent ejection of the ink from the ink ejection section based on a plurality of velocities that have been detected.

With this printing apparatus, even if the velocities that are detected include error, discrepancies in the positions where ink lands can be reduced.

In the printing apparatus, it is preferable that the printing apparatus calculates an average velocity based on the plurality of velocities that have been detected, and controls the timing of intermittent ejection of the ink from the ink ejection section based on the average velocity that has been calculated. With this printing apparatus, since the timing of ink election is controlled based on the average velocity obtained from a plurality of detected velocities, discrepancies in the positions where ink lands can be reduced even if there is error in the detected velocity.

In the printing apparatus, when the average velocity that has been calculated is slower than a velocity serving as a reference, the ink is ejected at a timing that is delayed compared to the timing of ejection of the ink for when the ink ejection section is moving at the velocity serving as the reference. In the printing apparatus, it is also preferable that the slower the average velocity that has been calculated is, the more the timing at which the ink is ejected is delayed. In the printing apparatus, it is also preferable that a delay amount of ink ejection is calculated based on the average velocity that has been calculated; and the ink ejection section ejects ink at a timing delayed by the delay amount from a signal that serves as a reference for the timing at which the ink is ejected. With these printing apparatuses, ink can be made to land at correct positions.

In the printing apparatus, it is preferable that an acceleration of the ink ejection section is calculated based on the plurality of velocities that have been detected; and the timing of intermittent ejection of the ink from the ink ejection section is controlled based on the acceleration that has been calculated. With this printing apparatus, ink can be made to land at correct positions even when the ink ejection section is accelerating or decelerating.

The printing apparatus further includes a memory for storing the velocities that have been detected. In the printing apparatus, it is also preferable that the velocity at which the ink ejection section moves is detected by an encoder. With these printing apparatuses, printing can be carried out with reduced error in velocity detection even if the encoder has low resolution.

In addition to these printing apparatuses, printing methods, programs, storage media, and computer systems are also made clear.

===Overview of Printing Apparatus (Inkjet Printer)===

<Regarding the Configuration of the Inkjet Printer>

Figure 2:
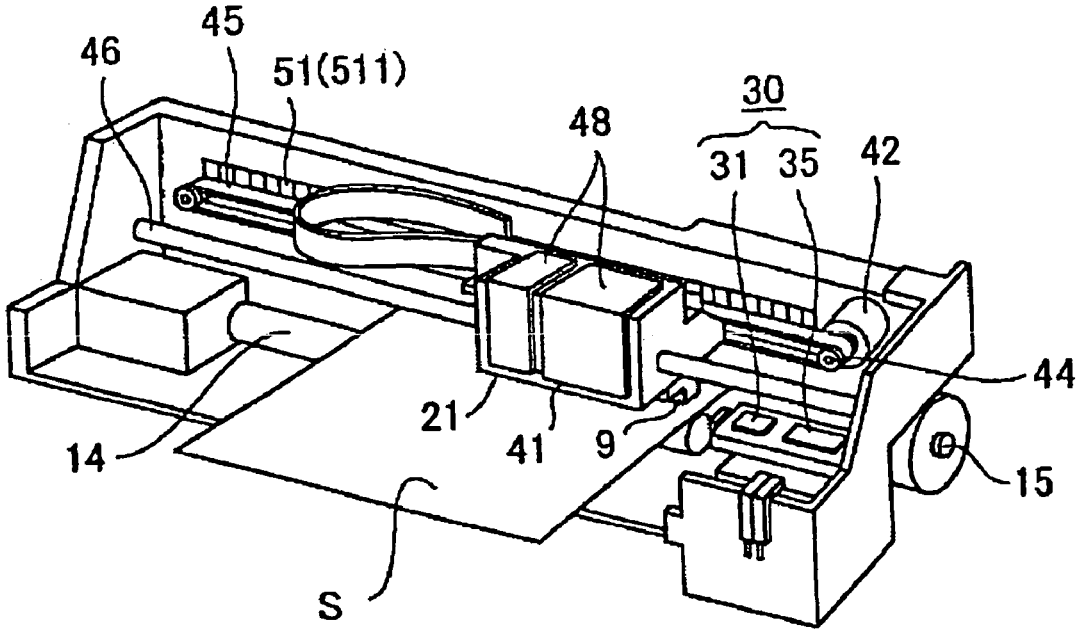
FIG. 2 is a diagram that schematically shows the carriage area of the inkjet printer of the present embodiment.
Figure 3:
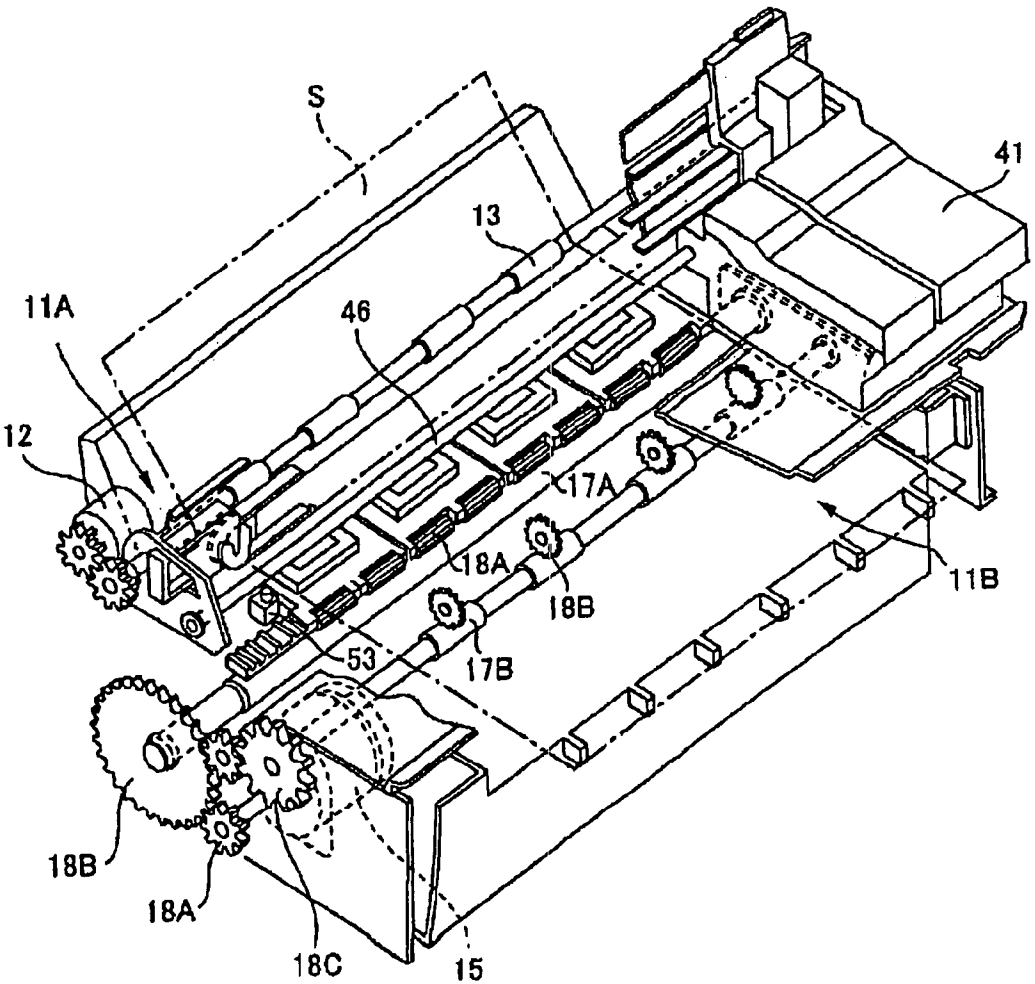
FIG. 3 is an explanatory diagram that schematically shows the carry unit area of the inkjet printer of the present embodiment.

An overview of an inkjet printer serving as an example of a printing apparatus is described with reference to FIG. 1, FIG. 2, and FIG. 3. It should be noted that FIG. 1 is an explanatory diagram of the overall configuration of an ink-jet printer of this embodiment. FIG. 2 is a schematic diagram of the carriage area of the inkjet printer of this embodiment. FIG. 3 is an explanatory diagram of the carrying unit area of the inkjet printer of this embodiment.

The inkjet printer of this embodiment has a paper carrying unit 10, an ink ejection unit 20, a cleaning unit 30, a carriage unit 40, a measuring instrument group 50, and a control unit 60.

The paper carrying unit 10 is for feeding paper, which is an example of a medium to be printed, into a printable position and making the paper move in a predetermined direction (the direction perpendicular to the paper face in FIG. 1 (hereinafter, this is referred to as the paper feed direction)) by a predetermined shift amount during printing. The paper carrying unit 10 has a paper supply insert opening 11A and a paper discharge opening 11B, a paper supply motor 12, a paper supply roller 13, a platen 14, a paper feed motor (hereinafter, referred to as PF motor) 15, a paper feed motor driver (hereinafter, referred to as PF motor driver) 16, a paper feed roller 17A and paper discharge rollers 17B, free rollers 18A and free rollers 18B, and gear wheels 19A, a gear wheel 19B, and a gearwheel 19C. The paper feed insert opening 11 is where paper, which is the medium to be printed, is inserted. The paper supply motor 12 is a motor for carrying the paper that has been inserted into the paper supply insert opening 11 into the printer, and is constituted by a DC motor. The paper supply roller 13 is a roller for carrying into the printer the paper that has been inserted into the paper supply insert opening 11, and is driven by the paper supply motor 12. The platen 14 supports the paper S during printing. The PF motor 15 is a motor for feeding paper, which is an example of a medium to be printed, in the paper feed direction, and is constituted by a DC motor. The PF motor driver 16 is for driving the PF motor 15. The paper feed roller 17A is a roller for feeding the paper S that has been carried into the printer by the paper supply roller 13 to a printable region, and is driven by the PF motor 15. The free rollers 18A are provided in a position that is in opposition to the paper feed roller 17A, and push the paper S toward the paper feed roller 17A by sandwiching the paper S between them and the paper feed roller 17A. The paper discharge rollers 17B are rollers for discharging, to outside the printer, the paper S for which printing has finished. The free rollers 18B are provided in a position that is in opposition to the paper discharge rollers 17B, and push the paper S toward the paper discharge rollers 17B by sandwiching the paper S between them and the paper discharge rollers 17B. The gear wheels 19A, the gear wheel 19B, and the gear wheel 19C are for transmitting the drive force of the PF motor 15 to the paper discharge rollers 17B so that the PF motor 15 drives the paper discharge rollers 17B. The paper discharge opening 11B is where paper for which printing is finished is discharged to outside the printer.

The ink ejection unit 20 is for ejecting ink onto paper, which is an example of the medium to be printed. The ink ejection unit 20 has a head 21 and a head driver 22. The head 21 has a plurality of nozzles, which are ink ejection sections, and ejects ink intermittently from each of the nozzles. The head driver 22 is for driving the head 21 so that ink is ejected intermittently from the head. It should be noted that the timing at which ink is ejected will be described later.

The cleaning unit 30 is for preventing the nozzles of the head 21 from becoming clogged. The cleaning unit 30 has a pump device 31 and a capping device 35. The pump device is for extracting ink from the nozzles in order to prevent the nozzles of the head 21 from becoming clogged, and has a pump motor 32 and a pump motor driver 33. The pump motor 32 sucks out ink from the nozzles of the head 21. The pump motor driver 33 drives the pump motor 32. The capping device 35 is for sealing the nozzles of the head 21 when printing is not being performed (during standby) so that the nozzles of the head 21 are kept from clogging.

The carriage unit 40 is for making the head 21 scan and move in a predetermined direction (in FIG. 1, the left to right direction of the paper face (hereinafter, this is referred to as the scanning direction)). The carriage unit 40 has a carriage 41, a carriage motor (hereinafter, referred to as CR motor) 42, a carriage motor driver (hereinafter, referred to as CR motor driver) 43, a pulley 44, a timing belt 45, and a guide rail 46. The carriage 41 can be moved in the scanning direction, and the head 21 is fastened to it (thus, the nozzles of the head 21 intermittently eject ink as they are moved in the scanning direction). The carriage 41 also removably holds ink cartridges 48 that accommodate ink. The CR motor 42 is a motor for moving the carriage in the scanning direction, and is constituted by a DC motor. The CR motor driver 43 is for driving the CR motor 42. The pulley 44 is attached to the rotation shaft of the CR motor 42. The timing belt 45 is driven by the pulley 44. The guide rail 46 is for guiding the carriage 41 in the scanning direction. It should be noted that the movement, for example, of the carriage 41 is described in detail later.

The measuring instrument group 50 includes a linear encoder 51, a rotary encoder 52, a paper detection sensor 53, and a gap sensor 54. The linear encoder 51 is for detecting the position of the carriage 41. The rotary encoder 52 is for detecting the amount of rotation of the PF motor 15. It should be noted that the configuration, for example, of the encoders is discussed later. The paper detection sensor 53 is for detecting the position of the rear edge of the paper to be printed. The gap sensor 54 is for detecting the distance PG from the nozzles to the paper S. It should be noted that the configuration, for example, of the gap sensor is discussed later.

The control unit 60 is for carrying out control of the printer. The control unit 60 has a CPU 61, a timer 62, an interface section 63, an ASIC 64, a memory 65, and a DC controller 66. The CPU 61 is for carrying out the overall control of the printer, and sends control commands to the DC controller 66, the PF motor driver 16, the CR motor driver 43, the pump motor driver 32, and the head driver 22. The timer 62 periodically generates interrupt signals with respect to the CPU 61. The interface section 63 exchanges data with a host computer 67 provided outside the printer. The ASIC 64 controls the printing resolution and the drive waveforms of the head, for example, based on print information sent from the host computer 67 through the interface section 63. The memory 65 is for reserving a work area and an area for storing the programs for the ASIC 64 and the CPU 61, for instance, and has storage means such as a PROM, a RAM, or an EEPROM. The DC controller 66 controls the PF motor driver 16 and the CR motor driver 43 based on control commands sent from the CPU 61 and the output from the measuring instrument group 50.

<Regarding the Configuration of the Encoders>

Figure 4:
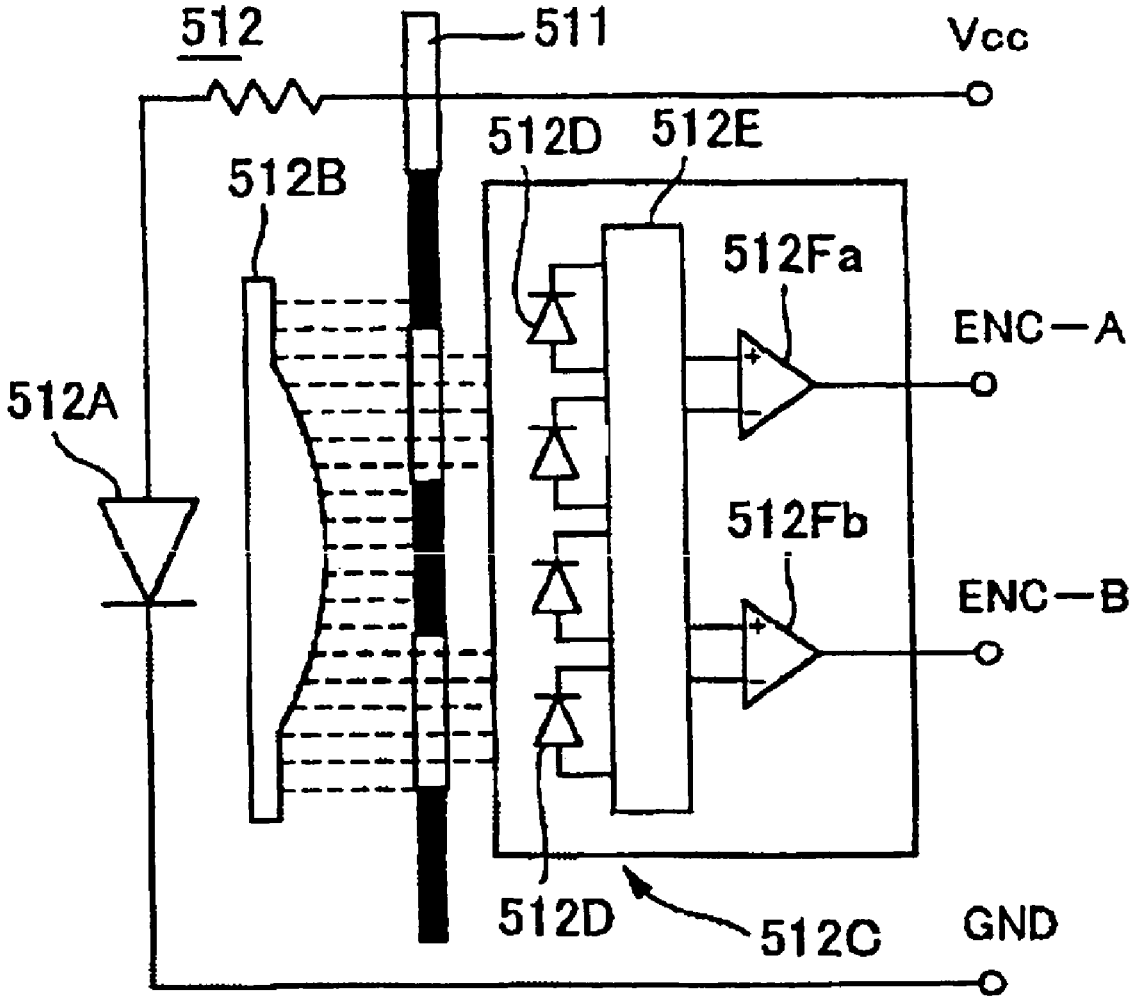
FIG. 4 is an explanatory diagram showing the configuration of the linear encoder.

FIG. 4 is an explanatory diagram of the linear encoder 51.

The linear encoder 51 is for detecting the position of the carriage 41, and has a linear scale 511 and a detection section 512.

The linear scale 511 is provided with slits at a predetermined spacing (for example, every 1/180 inch (1 inch equals 2.54 cm)), and is fastened to the main printer unit.

The detection section 512 is provided in opposition to the linear scale 511, and is on the carriage 41 side. The detection section 512 has a light-emitting diode 512A, a collimating lens 512B, and a detection processing section 512C. The detection processing section 512C is provided with a plurality of (for instance, four) photodiodes 512D, a signal processing circuit 512E, and two comparators 512Fa and 512Fb.

The light-emitting diode 512A emits light when a voltage Vcc is applied to it via resistors on both sides, and this light is incident on the collimating lens. The collimating lens 512B turns the light that is emitted from the light-emitting diode 512A into parallel light, and irradiates the parallel light on the linear scale 511. The parallel light that passes through the slits provided in the linear scale then passes through stationary slits (not shown) and is incident on the photodiodes 512D. The photodiodes 512D convert the incident light into electric signals. The electric signals that are output from the photodiodes are compared in the comparators 512Fa and 512Fb, and the results of these comparisons are output as pulses. Then, the pulse ENC-A and the pulse ENC-B that are output from the comparators 512Fa and 512Fb are the output of the linear encoder 51.

Figure 5A:
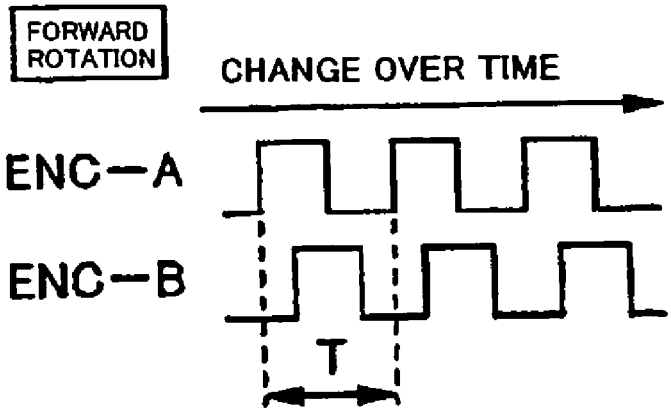
FIG. 5A is a timing chart of the waveform of the output signal when the CR motor 42 is rotating forward.
Figure 5B:
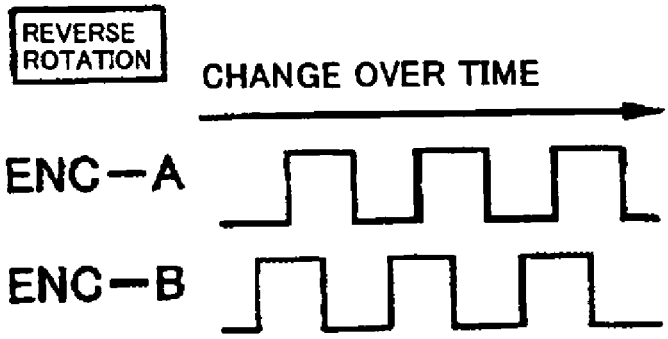
FIG. 5B is a timing chart of the waveform of the output signal when the CR motor 42 is rotating in reverse.

FIG. 5A is a timing chart of the waveform of the output signals of the linear encoder 51 when the CR motor 42 is rotating forward. FIG. 5B is a timing chart of the waveform of the output signals of the linear encoder 51 when the CR motor 42 is rotating in reverse.

As shown in FIG. 5A and FIG. 5B, the phases of the pulse ENC-A and the pulse ENC-B are misaligned by 90 degrees both when the CR motor 42 is rotating forward and when it is rotating in reverse. When the CR motor 42 is rotating forward, that is, when the carriage 41 is moving in the main-scanning direction, then, as shown in FIG. 5A, the phase of the pulse ENC-A leads the phase of the pulse ENC-B by 90 degrees. On the other hand, when the CR motor 42 is rotating in reverse, then, as shown in FIG. 5B, the phase of the pulse ENC-A is delayed by 90 degrees with respect to the phase of the pulse ENC-B. A single period T of the pulses is equivalent to the time during which the carriage 41 is moved by the spacing of the slits of the linear scale 511 (for example, by 1/180 inch (1 inch equals 2.54 cm)).

The position of the carriage 41 is detected as follows. First, the rising edge or the falling edge of either the pulse ENC-A or ENC-B is detected, and the number of detected edges is counted. The position of the carriage 41 is calculated based on the counted number. With respect to the counted number, when the CR motor 42 is rotating forward, a "+1" is added for each detected edge, and when the CR motor 42 is rotating in reverse, a "−1" is added for each detected edge. Since the period of the pulses ENC is equal to the slit spacing of the linear scale 511, when the counted number is multiplied by the slit spacing, the amount that the carriage 41 has moved from when the count number is "0" can be obtained. In other words, the resolution of the linear encoder 51 in this case is the slit spacing of the linear scale 511. It is also possible to detect the position of the carriage 41 using both the pulse ENC-A and the pulse ENC-B. The periods of the pulse ENC-A and the pulse ENC-B are equal to the slit spacing of the linear scale 511, and the phases of the pulse ENC-A and the pulse ENC-B are misaligned by 90 degrees, and therefore, if the rising edges and the falling edges of the pulses are detected and the number of detected edges is counted, then a counted number of "1" corresponds to ¼ of the slit spacing of the linear scale 511. Thus, if the counted number is multiplied by ¼ of the slit spacing, then the amount that the carriage 41 has moved from when the count number was "0" can be obtained. That is, the resolution of the linear encoder 51 in this case is ¼ the slit spacing of the linear scale 511. For the sake of simplifying the explanation, however, the position of the carriage 41 in this embodiment discussed later is detected using one pulse only.

The velocity Vc of the carriage 41 is detected as follows. First, the rising edges or the falling edges of either the pulse ENC-A or ENC-B are detected. The time interval between edges of the pulses is counted with a timer counter. The period T (T=T1, T2, . . . ) is obtained from the value that is counted. Then, when the slit spacing of the linear scale 511 is regarded as λ, the velocity of the carriage can be sequentially obtained as λ/T. It is also possible to detect the velocity of the carriage 41 using both the pulse ENC-A and the pulse ENC-B. By detecting the rising edges and the falling edges of the pulses, the time interval between edges, which corresponds to ¼ of the slit spacing of the linear scale 511, is counted by the timer counter. The period T (T=T1, T2, . . . ) is obtained from the value that is counted. Then, when the slit spacing of the linear scale 511 is regarded as X, the velocity Vc of the carriage can be found sequentially as Vc=λ/(4T). For the sake of simplifying the explanation, however, the velocity of the carriage 41 in this embodiment discussed later is detected using one pulse only.

It should be noted that the rotary encoder 52 differs from the linear encoder 51 only in that the linear scale 511 of the linear encoder 51 is a rotational disk that is rotated according to rotation of the PF motor 15, and other aspects of the configuration of the rotary encoder 52 are substantially the same as those of the linear encoder 51.

===Detection of PG===

Figure 6:
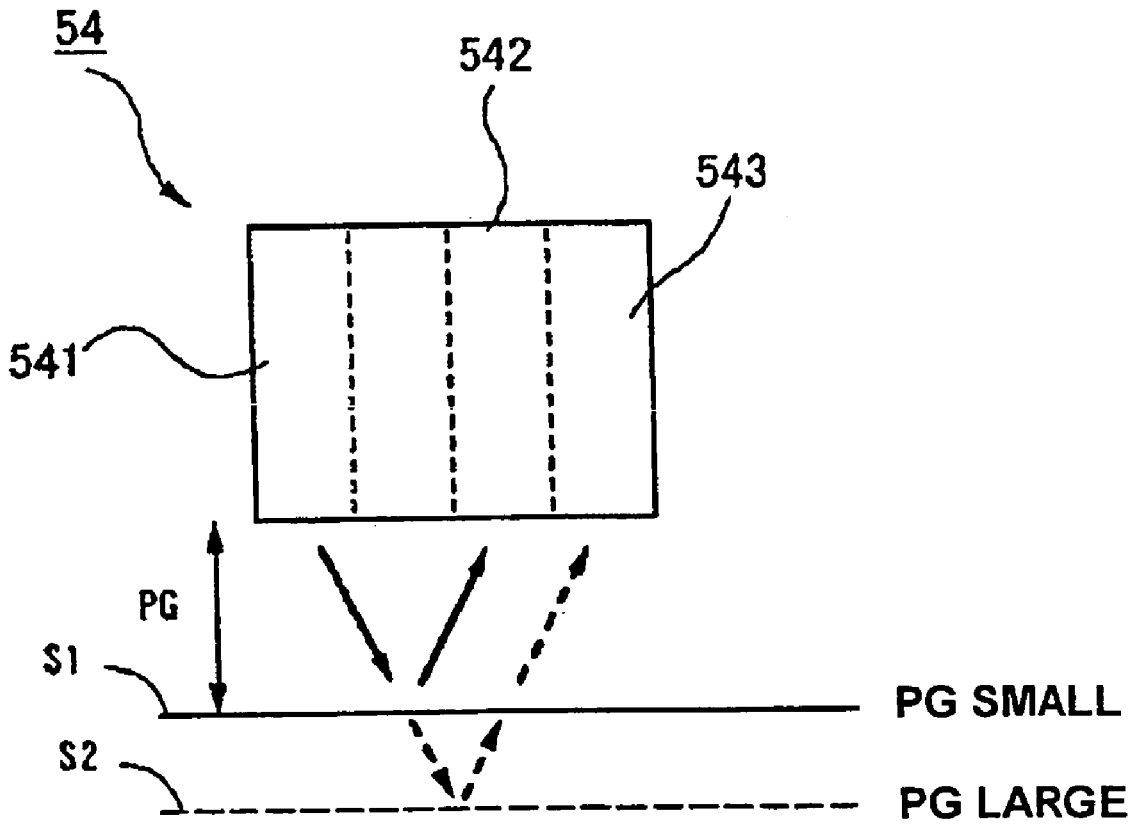
FIG. 6 is an explanatory diagram of the configuration of a gap sensor.

In this embodiment, the distance PG from the nozzles to the paper is detected in order to calculate a reference position, which is discussed later, and also to calculate the timing of the ejection of ink (discussed later). FIG. 6 is an explanatory diagram of the gap sensor for detecting the distance PG from the nozzles to the paper.

In the drawing, the gap sensor 54 has a light emitting section 541 and two light-receiving sections (a first light-receiving section 542 and a second light-receiving section 543). The light emitting section 541 has a light emitting diode and irradiates light onto the paper S, which is the medium to be printed. The first light-receiving section 542 has a light-receiving element that outputs electric signals corresponding to the amount of light that is received. The second light-receiving section 543 has a light-receiving element like that of the first light-receiving section 542. The second light-receiving section 543 is provided farther from the light emitting section 541 than the first light-receiving section 542.

Light that is emitted from the light emitting section 541 is incident on the paper S. The light that is incident on the paper S is reflected by the paper. The light that is reflected by the paper S is incident on the light-receiving elements. The light that is incident on the light-receiving elements is converted by the light-receiving elements into electric signals corresponding to the amount of light that is incident.

If the distance PG from the nozzles to the paper is small, then the light that is reflected by the paper S1 is primarily incident on the first light-receiving section 542 and only dispersed light is incident on the second light-receiving section 543. Consequently, the signals output by the first light-receiving section 542 are larger than the signals output by the second light-receiving section 543.

On the other hand, if the distance PG from the nozzles to the paper is large, then the light that is reflected by the paper S2 is primarily incident on the second light-receiving section 543 and only dispersed light is incident on the first light-receiving section 542. Consequently, the signals output by the second light-receiving section 543 are larger than the signals output by the first light-receiving section 542.

In this way, if the relationship between the distance PG and the ratio of the signals output by the light-receiving section is obtained in advance, then the distance PG from the nozzles to the paper can be detected based on the ratio of the output signals of the light-receiving section. In this case, information about the relationship between the distance PG and the ratio of the output signals of light-receiving section can be stored in the memory 65 as a table.

It should be noted that a conceivable example of a case where the distance PG from the nozzles to the paper is small is when the paper S1 is thick paper. Likewise, a conceivable example of a case in which the distance PG from the nozzles to the paper is large is when the paper S2 is thin paper.

Incidentally, a "reference distance PGs" described later may be determined in advance rather than detecting it with the sensor. In this case, the reference distance PGs is set to a value that is larger than the distance PG that is detected by the sensor.

In this embodiment, the distance PG is detected using the gap sensor 54 as described above, but the detection of the distance PG is not limited to one position, and as described below, it is also possible to detect the distance PG at a plurality of positions, for example.

<Detection of a Plurality of PGs in the Scanning Direction>

Figure 7:
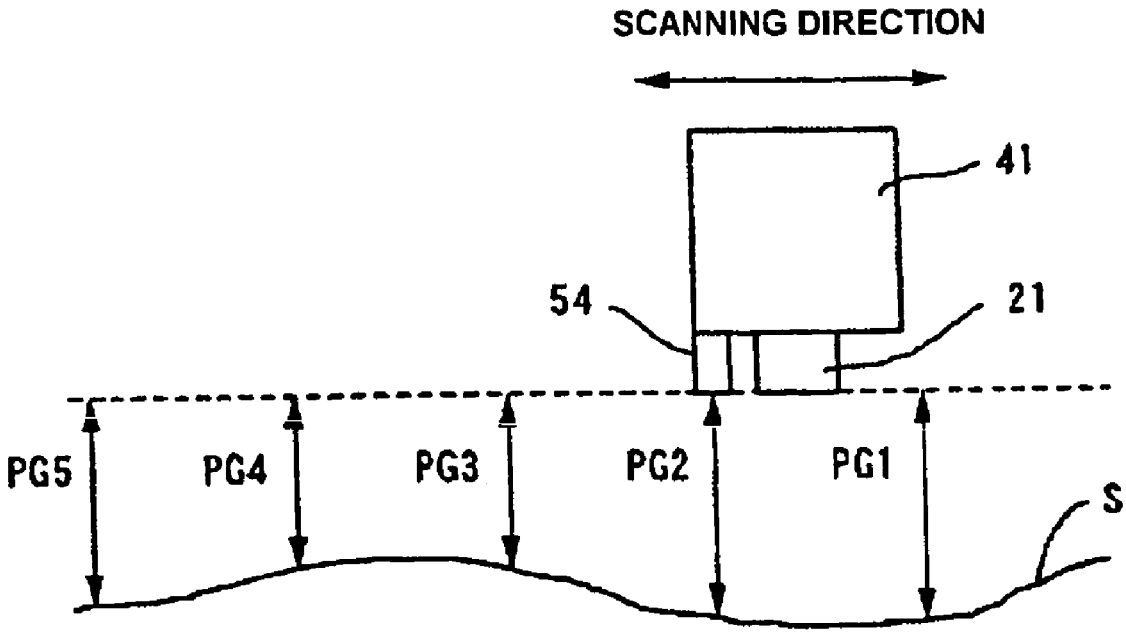
FIG. 7 is an explanatory diagram showing how the distance PG is detected at a plurality of positions in the scanning direction.

FIG. 7 is an explanatory diagram showing how the distance PG is measured by the gap sensor 54 at a plurality of positions in the scanning direction. FIG. 7 is a diagram seen from the paper feed direction, and the left to right direction of the paper face is the scanning direction. In the figure, identical structural components have been assigned like reference numerals, and therefore, a description thereof is omitted.

In the figure, the gap sensor 54 is provided on the carriage 41. Consequently, the gap sensor 54 can be moved in the scanning direction in conjunction with the movement of the carriage. In this way, the gap sensor 54 can detect the distance PG at a plurality of positions in the operating direction.

Since the gap sensor 54 can detect the distance PG at each area in the scanning direction, the timing of ink ejection (discussed later) can also be controlled at each area in the scanning direction.

For this reason, even if the paper S is bent during printing, the timing of the ejection of ink can be controlled for each area in the scanning direction, and thus high-precision printing can be carried out even if the nozzles intermittently eject ink in the scanning direction.

It should be noted that the influence of applying ink during printing, for example, is one conceivable cause for the paper S to bend in the scanning direction.

The method according to which the gap sensor 54 measures the distance PG at a plurality of positions in the scanning direction will be described in detail further below.

<Detection of a Plurality of PGs in the Paper Feed Direction>

Figure 8:
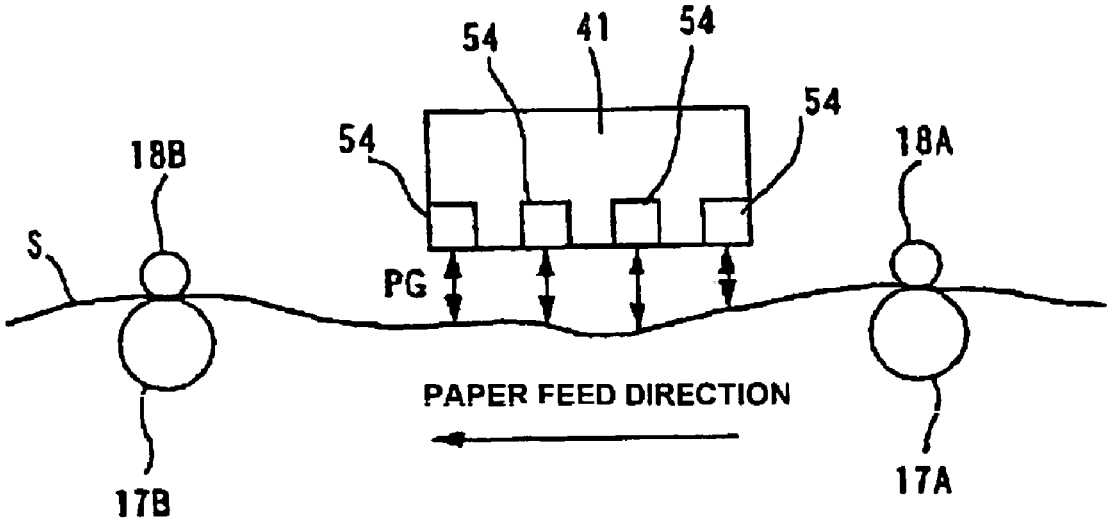
FIG. 8 is an explanatory diagram showing how the distance PG is detected at a plurality of positions in the paper feed direction.

FIG. 8 is an explanatory diagram showing how the distance PG is measured by the gap sensor 54 at a plurality of positions in the paper feed direction. FIG. 8 is a diagram seen from the scanning direction, and the left to right direction of the paper face is the paper feed direction. In the figure, identical structural components have been assigned like reference numerals, and therefore, a description thereof is omitted.

In the figure, a plurality of gap sensors are provided on the carriage, lined up in the paper feed direction. Consequently, the distance PG can be detected at a plurality of positions in the paper feed direction based on the output of each gap sensor.

When the distance PG can be measured by the gap sensors 54 at a plurality of positions in the paper feed direction, then since a plurality of nozzles are lined up in the paper feed direction, it is possible to control the timing of the ejection of ink at each nozzle (discussed later).

Thus, even if the paper S is bent during printing, the timing of the ejection of ink can be controlled at each nozzle, and thus high-precision printing can be carried out.

It should be noted that the influence of rotational displacement of the paper feed roller 17A and the paper discharge rollers 17B, for example, is a conceivable cause for the paper S to bend in the paper feed direction. Also, when the head is increased in size, resulting in long rows of nozzles in the paper feed direction, the variation in the distance PG from each nozzle to the paper S becomes large. In such a case, if the timing at which ink is ejected can be controlled at each nozzle, this is beneficial for high-precision printing.

===Detection of Ejection Velocity of Ink===

In this embodiment, the velocity Vi of ink ejection is detected in order to calculate the timing of ink ejection (discussed later).

The velocity at which the ink is ejected is, in general, larger the greater the amount of ink is. Consequently, if the printer changes the amount of ejected ink, then the velocity Vi at which ink is ejected is changed based on the amount of ejection of ink. For example, if the printer forms large dots and small dots on a paper, then the velocity at which ink is ejected when large dots are formed is greater than the velocity at which ink is ejected when small dots are formed.

Accordingly, in this embodiment, information about the velocity of ink ejection for each dot is stored in the memory 65 as a table, and the velocity of ink ejection is detected based on this table. That is, when the printer performs a print operation based on print information, the amount of ink that is ejected to form dots during printing is obtained from this print information, the table stored in the memory 65 is referenced based on the ejection amount that is obtained, and the velocity of the ink ejection is detected based on the table.

It should be noted that this table of information about the velocity of ink ejection can moreover be provided for each color of ink.

Incidentally, the "reference ejection velocity Vis" mentioned later may be determined in advance rather than being detected. In this case, the reference ejection velocity Vis is set so that it is a value that is not more than the ink ejection velocity Vi that is detected (a value that is not more than the ejection velocity of the small dots, for example).

===Carriage Velocity History===

Figure 9:
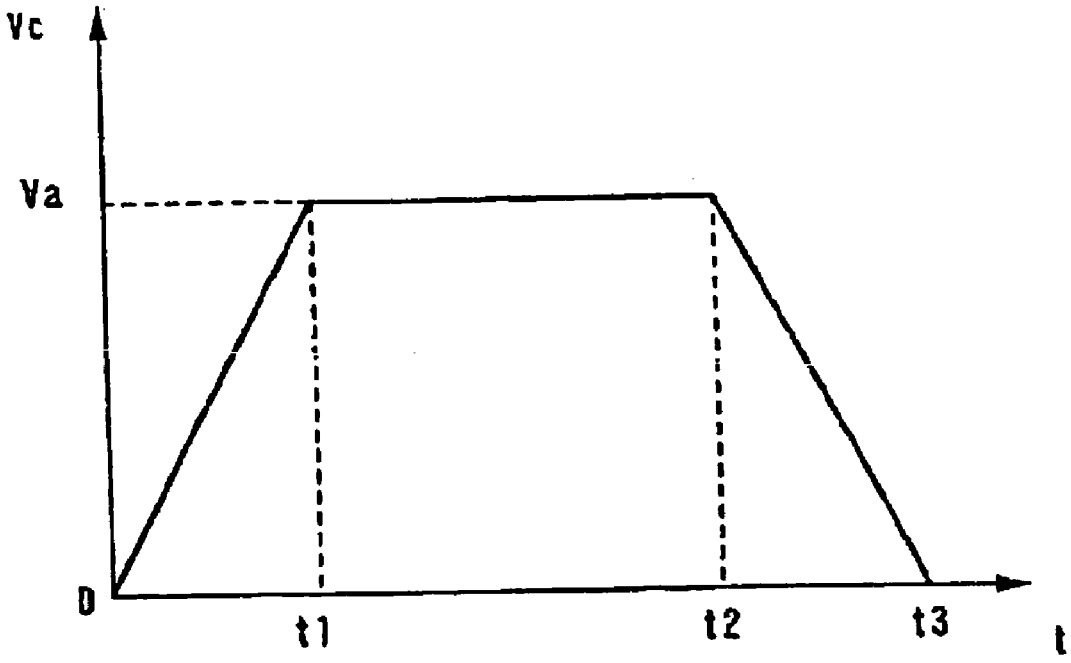
FIG. 9 is a diagram showing the change over time of the moving velocity of the carriage.

FIG. 9 is a graph showing the change over time of the target velocity of the movement of the carriage of the present embodiment. In the figure, the vertical axis is the target moving velocity Vc of the carriage, and the horizontal axis is the time t. It should be noted that the CR motor moves the carriage in such a manner that it follows this target velocity.

As shown in the drawing, from a stopped state (t=0), the carriage 41 accelerates to a predetermined maximum velocity Va (0<t<t1), scans at a constant velocity (hereinafter, this is referred to as the scanning velocity) (t1<t<t2), and then decelerates and comes to a stop (t2 <t<t3). Then, in the opposite direction, it accelerates, scans, and decelerates in the same fashion. By repeating this cycle, the carriage 41 is moved back and forth in the scanning direction.

Printing may be carried out using only the region in which the carriage 41 moves at the scanning velocity (hereinafter, referred to as the constant velocity region). When printing is carried out using only the constant velocity region, however, it is necessary to reserve a constant velocity region with the width of the printing region, thus making the printer large in size. Accordingly, in the present embodiment, printing is carried out in both the region where the carriage 41 accelerates and the region where it decelerates (hereinafter, these are referred to as the acceleration and deceleration regions).

On the other hand, since the carriage moves at a velocity that is less than the scanning velocity when accelerating and decelerating, when ink is ejected at the same timing in the acceleration and deceleration regions as it is in the scanning region, the ink droplets land in front of the target landing positions on the paper. In other words, when printing is performed in the acceleration and deceleration regions, it is necessary that the ejection of the ink is delayed with respect to the timing at which ink is ejected in the scanning region. This delayed timing is discussed later.

With this embodiment, a reduction in the size of the printer can be achieved because printing can be performed in the acceleration and deceleration regions as well.

Incidentally, the "reference velocity Vs" mentioned later may also be determined in advance rather than detecting it. In this case, the reference velocity Vs is set to a larger value than the moving velocity Vc of the carriage.

===Timing of Ink Ejection===

<Regarding the Trajectory of Ink Droplets>

Figure 10A:
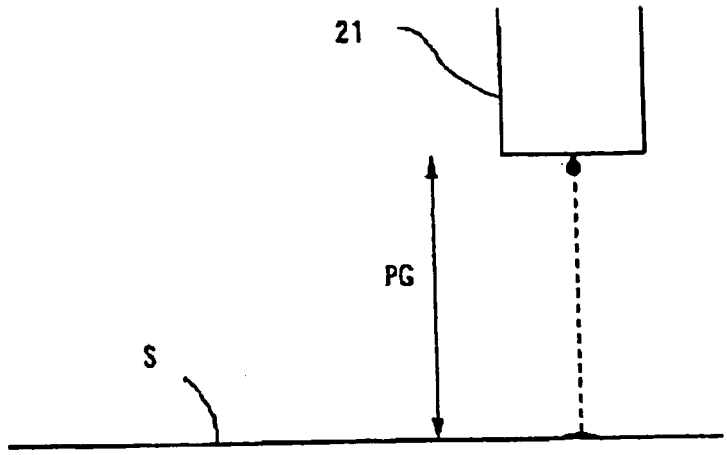
FIG. 10A to FIG. 10C are explanatory diagrams on the trajectory of ink droplets when ink is ejected from the nozzles.
Figure 10B:
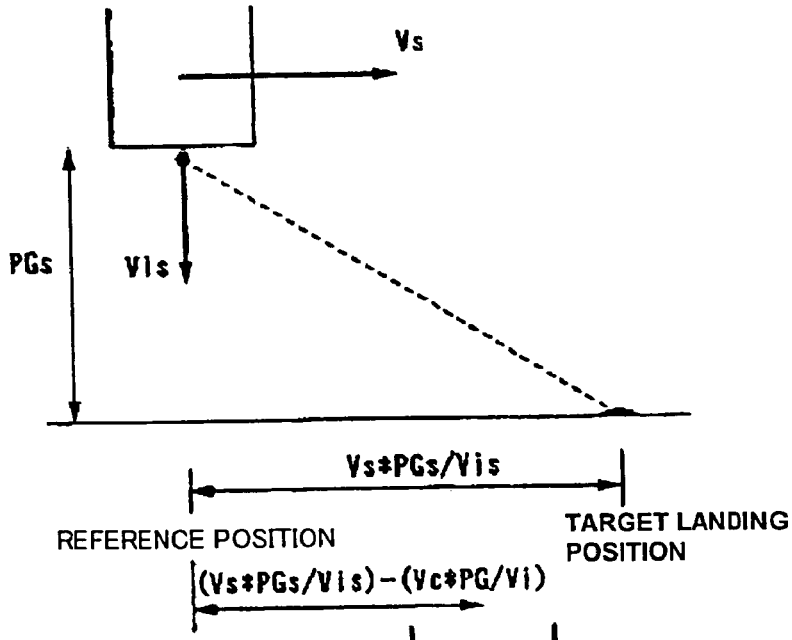
Figure 10C:
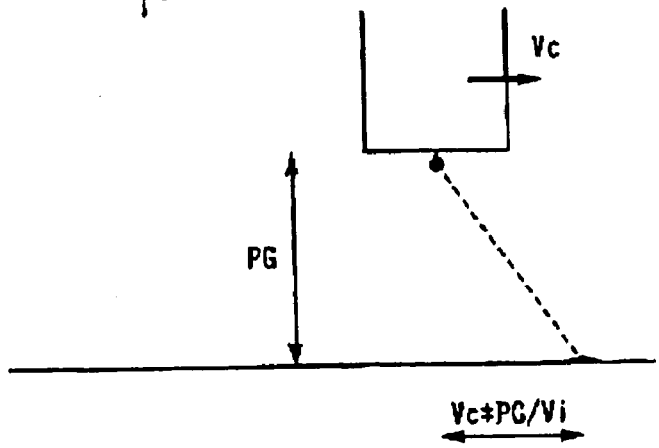

FIGS. 10A to 10C are explanatory diagrams on the trajectory of the ink droplets when ink is ejected from the nozzles. FIG. 10A is an explanatory diagram on the trajectory of ink droplets in a state where the nozzles are still (a state where the carriage 41 is still). FIG. 10B and FIG. 10C are explanatory diagrams on the trajectory of ink droplets in a state where the nozzles are moving (a state where the carriage 41 is moving). It should be noted that, although in practice ink is ejected intermittently from the nozzles, the number of ink droplets in FIG. 10 is limited for the sake of simplifying the explanation.

In FIG. 10A, the nozzles are in a still state, and therefore, when ink droplets are ejected, they land on the paper directly beneath the nozzles. When Vi is the velocity (ink ejection velocity) in the vertical direction (the direction toward the paper) of the ink droplets that are ejected from the nozzles and PG is the distance (gap) from the nozzles to the paper, the ink droplets land on the paper after the time PG/Vi from when they are ejected. It should be noted that the time from when the ink droplets are ejected until when they land on the paper will be referred to as the "travel time." Also, the "reference travel time" refers to the travel time of the ink where the ink ejection velocity is at a reference velocity Vis (hereinafter, referred to as the "reference ink ejection velocity") and the distance from the nozzles to the paper is at a reference distance PGs (hereinafter, referred to as the "reference distance").

In FIG. 10B, the carriage is moved in the scanning direction (left to right direction of paper face) at a predetermined velocity Vs serving as a reference (hereinafter, referred to as the "reference velocity"). When the carriage 41 moves at the velocity Vs, the nozzles also move at the velocity Vs in the scanning direction. On the other hand, when the velocity of the ink droplets in the vertical direction is set to the reference ink ejection velocity Vis and the distance from the nozzles to the paper is set to the reference distance PGs, the ink droplets land on the paper after the reference travel time has passed from ejection. Accordingly, due to the law of inertia, the ink droplets land on the paper at positions that are displaced in the scanning direction by the distance Vs×PGs/Vis from the position of the nozzles when the ink is ejected. Consequently, to make the ink droplets land at a predetermined position on the paper (hereinafter, referred to as the "target landing position"), it is necessary to eject the ink droplets from the nozzles at a timing with which the nozzles are located preceding the target landing position by the distance Vs×PGs/Vis.

In this embodiment, the position at which a nozzle ejects ink droplets in order to make the ink droplets land at the target landing position when the carriage 41 is moving at a predetermined reference velocity Vs is referred to as the "reference position." Also, the timing at which the nozzles arrive at the reference position is referred to as the "reference timing." In other words, when the carriage 41 is moved at the reference velocity Vs, the distance from the nozzles to the paper is the reference distance PGs, and the ink droplets are ejected at the reference ink ejection velocity Vis, then, if the ink droplets are ejected from the nozzles at the reference timing by the carriage 41, the ink droplets can be made to land at the target landing positions, allowing dots to be formed at predetermined positions on the paper. In this embodiment, the reference position is calculated as the position preceding the target landing position by Vs×PGs/Vis.

In FIG. 10C, the carriage 41 moves at a velocity Vc that is slower than the reference velocity Vs, the distance PG from the nozzles to the paper is shorter than the reference distance PGs, and the ink droplets are ejected at an ink ejection velocity Vi that is faster than the reference ink ejection velocity Vis. In this case, the position where the ink droplets land is a position that is misaligned in the scanning direction by Vc×PG/Vi from the position of the nozzles when the ink droplets are ejected. If ink were ejected at the reference position, then the ink droplets would land preceding the target landing position by (Vs×PGs/Vis)−(Vc×PG/Vi). Consequently, to make the ink droplets land at the target landing position (to form dots at a predetermined position on the paper), it is necessary to eject ink droplets from the nozzles at a timing where the nozzles have passed the reference position by (Vs×PGs/Vis)−(Vc×PG/Vi). To put it differently, if the carriage 41 moves slower than the reference velocity Vs, the distance PG from the nozzles to the paper is shorter than the reference distance PGs, and ink droplets are ejected at an ink ejection velocity Vi that is faster than the reference ink ejection velocity Vis, then to make the ink droplets land at the target landing position, it is necessary to delay the timing at which the ink droplets are ejected by a predetermined amount of time after the carriage 41 arrives at the reference position (i.e., after the reference timing).

In other words, in this embodiment, the velocity Vc at which the carriage is moved, the distance PG from the nozzles to the paper, and the ink ejection velocity Vi are taken into account when obtaining the delayed timing.

It should be noted that if the reference velocity Vs set in advance is faster than the scanning velocity Va, then the timing of ink ejection, which is discussed later, can be applied to not only the acceleration and deceleration regions but also to the scanning region as well.

<Regarding the Delayed Timing>

As mentioned above, to make ink droplets land at a target landing position, it is necessary to eject the ink droplets from the nozzles at a delayed timing with which the nozzles move past the reference position by (Vs×PGs/Vis)−(Vc×PG/Vi). Accordingly, in this embodiment, as mentioned below, the period of the pulses ENC of the linear encoder 51 are segmented to n segments and the m-th segment corresponding to the amount of delay is calculated, so as to control the timing of ejection of ink droplets.

Figures 11A, 11B, 11C:
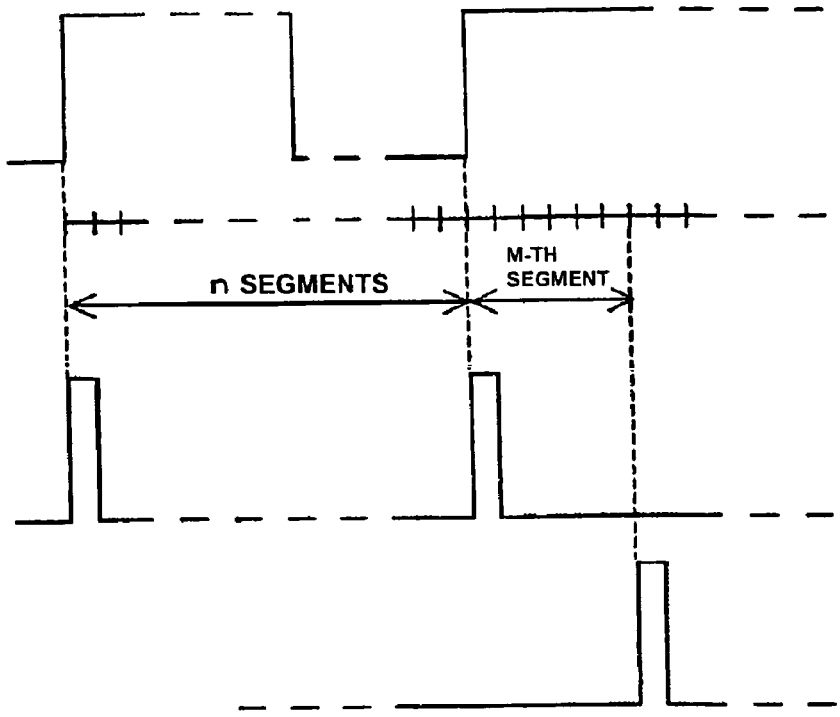
FIG. 11A shows the waveform of the output signal of the linear encoder 51.
FIG. 11B and FIG. 11C are explanatory diagrams showing waveforms of head drive signals.

FIG. 11A shows the waveform of the output signal by the linear encoder 51. A pulse ENC of one period being output from the linear encoder 51 means that the carriage 41 has moved by the slit spacing of the linear scale 511. For example, when the slit spacing of the linear scale 511 is 1/180 inch, then when a pulse signal of one period is output from the linear encoder 51, this means that the carriage 41 has moved 1/180 inch. That is, the resolution at which the position of the carriage 41 is detected by the linear encoder 51 is 1/180 inch.

FIG. 11B shows the head drive signal when the carriage 41 is moved at the reference velocity Vs, the distance from the nozzles to the paper is the reference distance PGs, and ink droplets are ejected at the reference ink ejection velocity Vis. The nozzles of the head 21 eject ink according to the timing at which the head drive signal is received. In this case, since the carriage 41 is moved at the reference velocity Vs, the head drive signal is generated at a timing where the carriage 41 arrives at the reference position, and ink is ejected at this timing. Here, since the position of the carriage 41 is detected within the range of the resolution of the linear encoder 51, the head drive signal is generated at the same timing as the rising edge of the pulse signal of the linear encoder 51.

FIG. 11C shows a head drive signal when the carriage 41 moved at a velocity Vc (<Vs), the distance from the nozzles to the paper is PG (<PGs), and the ink ejection velocity is Vi (>Vis). The nozzles of the head 21 eject ink according to the timing at which the head drive signal is received. The head drive signal in this case is generated at a timing that is delayed from when the carriage 41 has arrived at the reference position. That is, the head drive signal of FIG. 11C is generated at a timing that is delayed when compared to the timing of the head drive signal of FIG. 11B (reference timing). For that reason, in this case, the ink droplets are ejected at a timing that is delayed with respect to the reference timing. It should be noted that the calculation of the velocity Vc of the carriage 41 is discussed later.

In this embodiment, each period of the pulse ENC of the linear encoder 51 is segmented into n segments and the m-th segment corresponding to the amount of delay is calculated, and control is performed so that the head drive signal is generated at a timing corresponding to the m-th segment.

In other words, first, the period T immediately prior to the pulse ENC of the linear encoder 51 is divided into n segments (or the distance λ moved in one period is segmented into n segments). If a single period is divided into n segments, then when the slit spacing of the linear scale 511 is λ, a single segment corresponds to λ/n. For example, if one period is divided into 128 segments and the slit spacing of the linear scale 511 is 1/180 inch, then one segment corresponds to approximately 1.1 μm. It should be noted that for the sake of easing calculation by the control unit 60, n is preferably a power of 2.

Next, the segment corresponding to the amount by which it is necessary to delay the head drive signal is calculated. When the timing corresponding to the amount of delay is the m-th segment, then m=(correction distance)/(λ/n). It should be noted that the correction distance, as mentioned above, is (Vs×PGs/Vis)−(Vc×PG/Vi). That is, m is calculated by the following equation.

$$m = \frac{n}{\lambda} \times \left\{ \left( Vs \times \frac{PGs}{Vis} \right) - \left( Vc \times \frac{PG}{Vi} \right) \right\}$$

However, since it is necessary to make m an integer, if m is not an integer in the above equation, then it is made an integer by rounding down, rounding to the nearest whole number, or rounding up, for example.

Then, the head drive signal is generated when the time corresponding to the m-th segment from the rising edge of the pulse signal of the linear encoder 51 is reached. In other words, the head drive signal is generated at a delayed timing corresponding to the m-th segment from the rising edge of the pulse signal of the linear encoder 51. In this way, ink droplets can be ejected from the nozzles at a timing delayed such that the nozzles move past the reference position by (Vs×PGs/Vis)−(Vc×PG/Vi).

As can also be understood from Equation 1 above, the smaller the velocity Vc of the carriage 41, the greater the delay in the timing at which ink is ejected. On the other hand, the larger the velocity Vc, the smaller the delay in the timing at which ink is ejected. Also, the smaller the distance PG from the nozzles to the paper, the greater the delay in the timing at which ink is ejected, whereas the greater the distance PG, the smaller the delay in the timing at which the ink is ejected. Furthermore, the slower the ejection velocity Vi of the ink droplets in the vertical direction, the smaller the delay in the timing at which ink is ejected, whereas the faster the ejection velocity Vi, the larger the delay in the timing at which ink is ejected.

According to this embodiment, control is performed so that the timing at which ink is ejected from the nozzles is a timing that is delayed with respect to the reference position, based on the moving velocity Vc of the carriage, the distance PG from the nozzles to the paper, and the ink ejection velocity Vi. Therefore, the printer of this embodiment can perform precise printing.

It should be noted that in the embodiment described above, the number of ink droplets was limited for the sake of simplifying the explanation. However, even when ink is intermittently discharged from the nozzles, the timing at which each ink droplet is ejected is controlled in the same manner.

===Setting the Reference Velocity===

Next, the velocity to which the reference velocity mentioned above is set is described.

<Regarding the Limit of the Head Drive Period>

Figure 12:
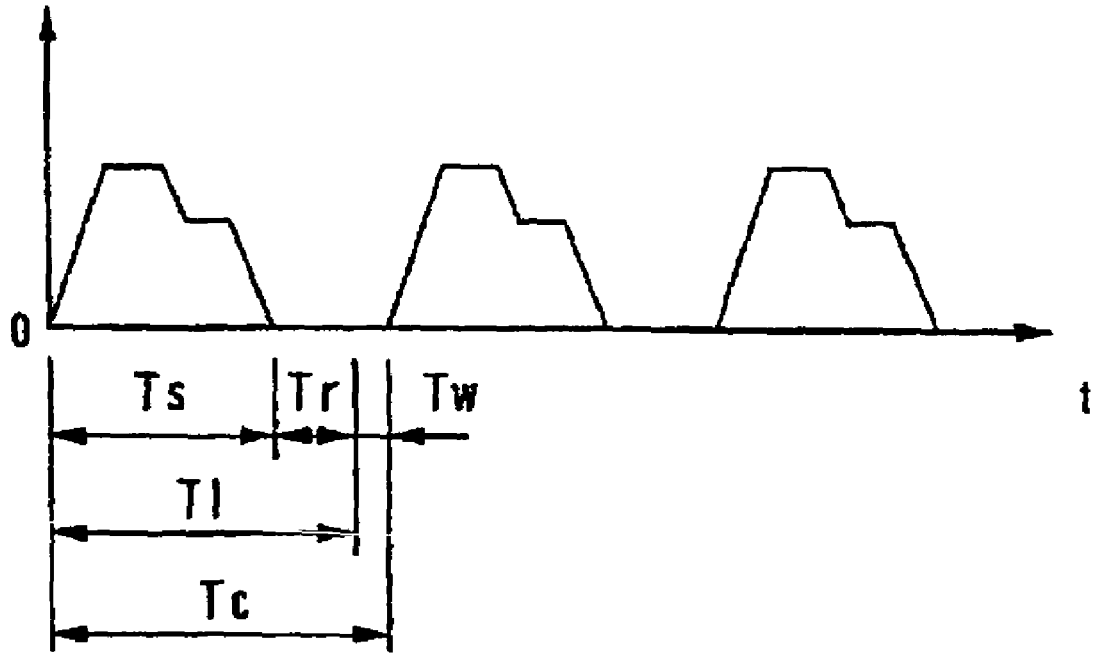
FIG. 12 is a diagram showing a waveform of the head drive signal.

FIG. 12 shows the waveform of the head drive signal. Since the nozzles of the head eject ink intermittently, the head receives a drive signal for ejecting ink at a predetermined period. The head is provided with piezo elements as elements for ejecting ink, and when the piezo elements receive a drive signal of a predetermined shape they are displaced, and ink is ejected from the nozzles.

The initial time Ts of the head drive signal is the time required for displacing the piezo elements. Next, the time Tr of the head drive signal is the time required for the displaced piezo elements to return to their original state. Next, the time Tw of the head drive signal is the standby time until the next signal is received. In the drawing, the period of the intermittent ejection of ink is Tc (=Ts+Tr+Tw).

Next, the limit of the drive period of the head is considered. To eject ink from the nozzles, it is necessary to secure the time Ts for the required displacement of the piezo elements. Moreover, when the time Tr is not secured, the piezo elements do not return to their original state, and thus ink cannot be accurately ejected even if the next signal is received. On the other hand, when the time Tw is large, the period of intermittent ejection of the ink is slowed, and thus the printing velocity of the printer becomes slow consequently, the limit of the drive period of the head is Ts+Tr (=T1). It should be noted that since the amount of displacement of the piezo elements differs depending on the amount of ink that is ejected, the time Ts differs according to the amount of ejected ink. In considering the limit of the drive period of the head in this case, a large Ts value (for example, the Ts when large dots are formed) is taken as the reference.

<Regarding the Reference Velocity>

The spacing of the dots formed on the paper is determined by the printer settings and performance. For example, if the printer is set to 180 dpi, then the spacing between dots that are formed on the paper is $1/180$ inch.

The reference velocity Vs is set to be the maximum carriage velocity at which printing is possible at that dot spacing. Here, when T1 is the limit drive period of the head and L is the spacing between dots formed on the paper, the reference velocity Vs is defined as Vs=L/Tl.

It should be noted that if the carriage (or in other words, the nozzles) is moved faster than the reference velocity, then (1) if ink is ejected at the drive limit of the head, then the dot spacing becomes wide, and (2) if the dot spacing is maintained, then the time Tr is not secured and the piezo elements do not return to their original state, and thus ink cannot be ejected accurately.

<Relationship Between Reference Velocity and Target Velocity>

Figure 13:
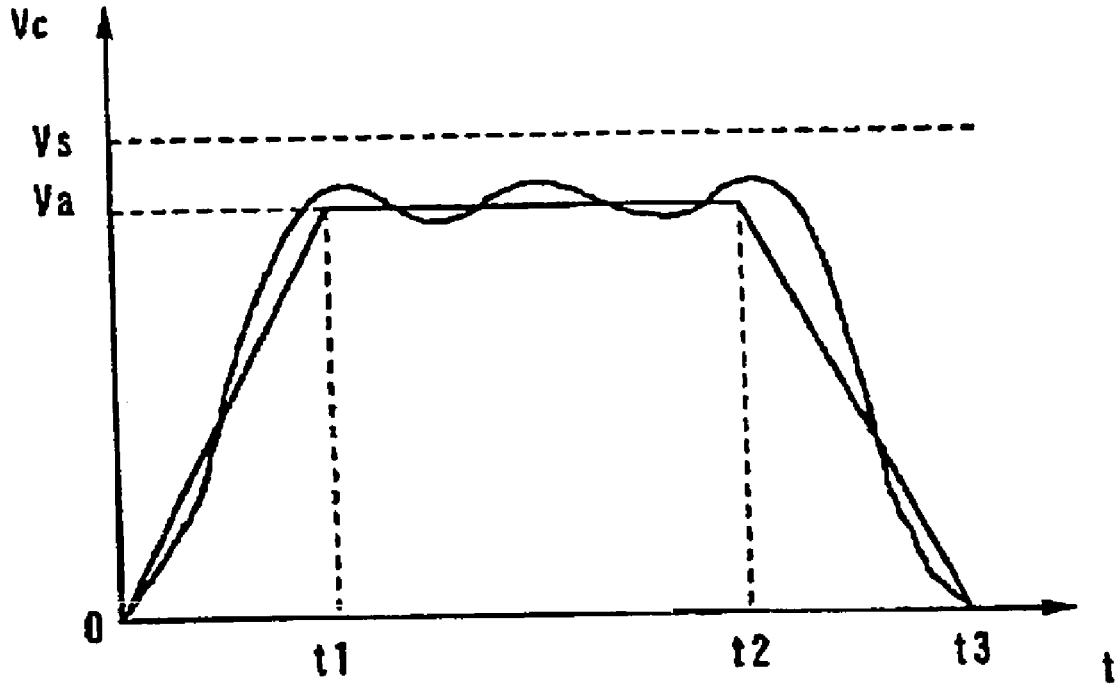
FIG. 13 is a diagram showing the change over time of the target moving velocity of the carriage and the moving velocity of the carriage.

FIG. 13 is a graph of the target moving velocity of the carriage shown in FIG. 9 and the moving velocity of the carriage that is detected by the encoder. As shown in the graph, the detected moving velocity of the carriage (that is, the moving velocity of the nozzles) is a different value than the target moving velocity due to variation in the cogging and the pulley of the motor.

As shown in the graph, the reference velocity Vs has been set so that it is faster than the maximum value Va of the target moving velocity (that is, the maximum value Va of the target moving velocity is set so that it is slower than the reference velocity). In this way, the delay amount m of the timing for ink ejection can be calculated using the same calculations regardless of whether the carriage is in the acceleration or deceleration regions or the carriage is in the constant velocity region.

Furthermore, the reference velocity Vs is 4 to 6% (more preferably 4 to 5.5%) faster than the maximum velocity of the target moving velocity. In this way, even if the actual moving velocity of the carriage (the moving velocity of the carriage that is detected) does not match the target moving velocity, the actual moving velocity of the carriage can be kept from becoming faster than the reference velocity. As a result, the head can eject ink accurately. It should be noted that the reason the reference velocity Vs is set so that it is 4 to 6% faster than the maximum velocity of the target moving velocity is because (1) the discrepancy with respect to the target moving velocity called by variation in the cogging or the pulley of the motor is about 0.2 to 1.5% and thus it is sufficient if 4 to 6% is secured, and (2) when the difference between the reference velocity and the target velocity is too large, the moving velocity of the carriage becomes slow and there is a significant drop in the printing velocity of the printer.

<Relationship Between Reference Velocity and Vc)>

As described above, the detected moving velocity of the carriage, in principle, does not exceed the reference velocity Vs. Consequently, ordinarily, the velocity of the carriage that is detected by the encoder can be used, without change, as the velocity Vc of the carriage that is used to calculate the delay amount m.

However, when the carriage is subjected to a load of some kind that pushes the moving velocity of the carriage over the reference velocity Vs, then a head drive signal that exceeds the limit of the drive period of the head may be output, or the delay amount m of the timing of ink ejection may become a negative number, and printing can no longer be carried out.

Figure 14:
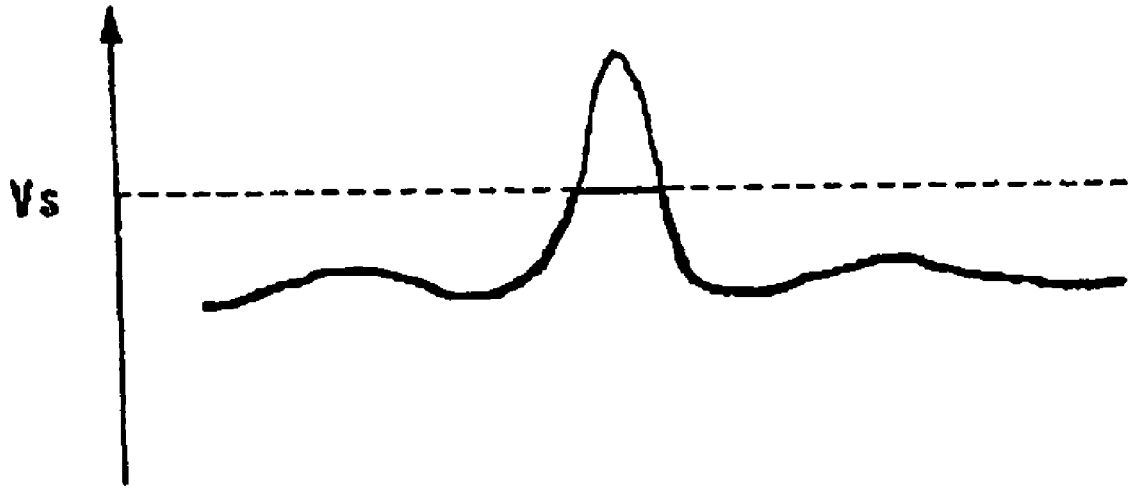
FIG. 14 is an explanatory diagram of the velocity Vc of the carriage that is used to calculate the delay amount m.

Accordingly, as shown by the bold line in FIG. 14, if the moving velocity of the carriage that is detected exceeds the reference velocity Vs, then the velocity Vc of the carriage that is used to calculate the delay amount m is made equal to the reference velocity Vs (that is, the delay amount m becomes zero and ink is ejected at the same timing as when the carriage is moved at the reference velocity Vs).

In this way, while ink droplets are made to land at correct positions as much as possible, the execution of printing beyond the capacity of the head can be avoided.

===Calculation of the Average Velocity===

<Regarding the Average Velocity>

When the velocity Vc of the carriage 41 is calculated as Vc=λ/T using the immediately prior period T of the linear encoder, if the output of the linear encoder includes error or there is variation in the velocity such as cogging, then ink cannot be made to land in correct positions.

Accordingly, in this embodiment, the linear encoder is used to sequentially detect the velocity at which the carriage moves (that is, the velocity at which the nozzles move), the average velocity is calculated from the plurality of detected velocities, and based on the average velocity, the delay amount m of the timing of ink ejection is calculated.

Figure 15:
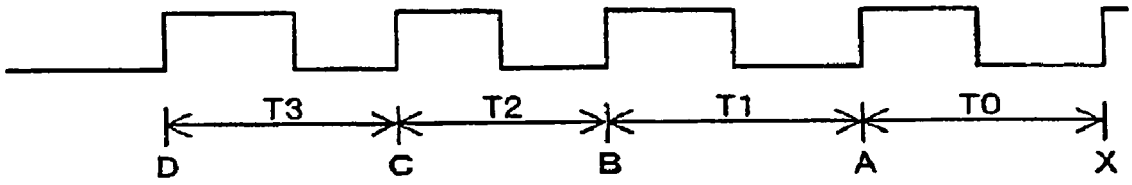
FIG. 15 is the waveform of the output signal of the encoder when the carriage is moving.

FIG. 15 shows the waveform of the output signal of the linear encoder 51 when the carriage is moving. It should be noted that in the figure, the carriage is located at the position A. Consequently, the signals of sections A to D are signals that have been output already, and the signals of the section A to X are signal that are expected to be output in the future.

In the figure, there is variation in the period of the pulsed signal of the linear encoder 51 due to measurement error or cogging, for example. For this reason, if the slit spacing λ is divided by the immediately preceding period T1 to calculate Vc and the delay amount m of ink ejection in the section A to X is calculated based on this Vc, significant error will be included in the delay amount m.

Accordingly, to calculate the delay amount m more accurately, in this embodiment, the following procedure is performed to calculate the velocity Vc in section A to X and then calculate the delay amount m.

First, the velocity V3 of the carriage in the section D to C is detected based on the period T3 of the section D to C. Likewise, the velocity V2 of the carriage in the section C to B and the velocity V1 of the carriage in the section B to A are detected. Then, based on the plurality of velocities that are detected, the average velocity of the carriage is calculated as V=(V3+V2+V1)/3. In this case, the sequentially detected velocities of the carriage can be stored in a memory. The average velocity that is calculated is regarded as the velocity Vc of the carriage in the section A to X, and is used to calculate the delay amount m.

It should be noted that with respect to the timing of ink ejection, the rising edge of A serves as the reference and the timing of ink ejection is delayed by the delay amount m from this reference.

In the above description, the delay amount m was calculated from the reference A based on the average velocity over the sections D to A. However, calculation of the delay amount m may require time. Accordingly, it is possible to detect the velocity in the sections prior to B, calculate the average velocity and the delay amount m during the section B to A, and then eject ink at a timing delayed by the delay amount m from the reference A.

As described in detail above, in this embodiment, the timing of ink ejection is controlled based on the average velocity of the carriage, and thus even if there is error in the detected velocities or the period, variation in the landing position of the ink can be reduced.

===Compensating for the Amount of Change in Carriage Velocity===

<Regarding Calculation of the Delay Amount m>

If the carriage is moving at a constant velocity, then the velocity Vc at which the carriage moves can be calculated as Vc=λ/T using the pulse period T of the linear encoder 51 and the slit spacing λ of the linear scale.

If the carriage is moving with acceleration or deceleration, however, then even if the delay amount m of ink ejection is calculated using the velocity Vc (Vc=λ/T) at which the carriage moves, the velocity of the carriage when ink is ejected is different from λ/T (that is, the period T is a value of the past), and therefore ink cannot be made to land at a target position.

Accordingly, in this embodiment, to obtain the velocity Vc of the carriage when ink is ejected, the velocity Vc is calculated taking into account the acceleration of the carriage (that is, the acceleration of the nozzles). Moreover, in this embodiment, the acceleration of the carriage (that is, the acceleration of the nozzles) is calculated based on a plurality of detected velocities, and the velocity Vc is calculated based on the acceleration that has been calculated.

Figure 16:
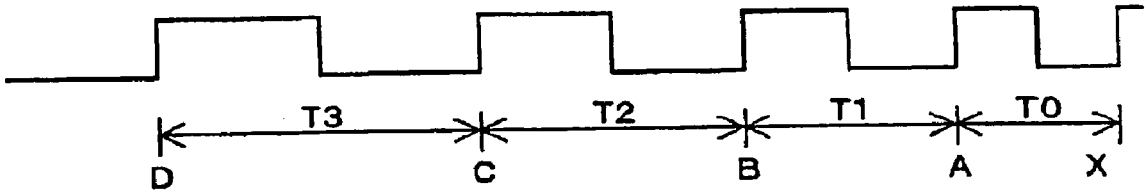
FIG. 16 is the waveform of the output signal of the encoder when the carriage is accelerating.

FIG. 16 shows the waveform of an output signal of the linear encoder 51 when the carriage is accelerating. It should be noted that the carriage is at the position A. Consequently, the signals of sections A to D are signals that have already been output, and the signals of the section A to X are signals that are expected to be output in the future.

In the figure, the velocity increases gradually because the carriage is accelerating, and thus the period T gradually becomes shorter. Consequently, the anticipated period T0 of the output signal is expected to be shorter than T1 immediately preceding it. For that reason, if the slit spacing λ is divided by the period T1 (or any period before it such as period T2) to find Vc, and the delay amount m of ink ejection in the section A to X is calculated based on that Vc, then the delay amount becomes large.

Accordingly, to calculate the delay amount more accurately, in this embodiment, the velocity Vc in the section A to X is calculated and then the delay amount m is calculated as illustrated below.

First, the velocity V2 of the carriage in the section C to B is detected based on the period T2 of the section C to B. Likewise, the velocity V1 of carriage in the section B to A is detected based on the period T1 of the section B to A. It should be noted that the velocity that is detected is stored in the memory. Then, the acceleration of the carriage is detected based on the difference between the velocities V1 and V2 that are detected. If the acceleration of the carriage can be obtained, then it is possible to calculate the velocity V0 of the carriage that is expected in the section A to X and the period T0 that is expected in the section A to X. If the velocity V0 of the carriage can be calculated, then that velocity V0 can be used as the Vc to calculate the delay amount m.

It should be noted that with respect to the timing of ink ejection, the rising edge of A serves as a reference and ink ejection occurs at a position delayed by the delay amount m from that reference.

In the above description, the acceleration was calculated based on the velocities V2 and V1 of the section C to B and the section B to A in order to calculate the delay amount m from the reference A. However, the calculation of the delay amount m may take time. Accordingly, it is also possible to detect the velocities V3 and V2 of the section D to C and the section C to B, calculate the acceleration, V0 and the delay amount m during the section B to A, and then eject ink at a timing delayed by the delay amount m from the reference A.

It is also possible to calculate the average acceleration based on the difference between V3 and V2 and the difference between V2 and V1, and based on the average acceleration that is calculated, to calculate the velocity V0 (=Vc) of the carriage and the delay amount m expected in the section A to X.

Also, since the velocity of the carriage also changes as the carriage is moved for the delay amount, the velocity Vc may also be calculated based on the acceleration of the carriage, taking into consideration this delay amount also.

It should be noted that in this embodiment, the acceleration of the carriage is positive, and thus the period T gradually becomes shorter and the period of the timing of ink ejection becomes shorter. On the other hand, when the acceleration of the carriage is negative (i.e., when the carriage is decelerating), the period T gradually becomes longer and the period of the timing of ink ejection becomes longer.

<1 Regarding Generation of the Reference Signal>

There are cases in which the election of ink droplets is carried out at a shorter spacing than the resolution at which the linear encoder 51 carries out position detection. An example would be a case where the ejection of ink is performed at a spacing of 1/720 inch when the resolution of the linear encoder 51 is 1/180 inch.

In such a case, ordinarily, reference signals are generated at intervals at which the pulse period T of the linear encoder immediately prior is divided, for example, into four segments, and those reference signals serve as a trigger for carrying out ink ejection.

However, if the immediately preceding pulse period T includes a large detection error, the ink will not land at an equal spacing.

Accordingly, to make the spacing at which the ink lands an equal spacing, the period T0 expected for the section A to X is calculated based on a plurality of detected velocities of the carriage, and signals serving as a reference for the timing at which ink is ejected are generated in such a manner that the period T0 that is calculated is segmented into equal intervals.

In this way, since the signals serving as the reference for the timing of ink ejection are generated based on an average of the plurality of detected signals, variation in the landing position of the ink can be reduced even if the detected velocity or the period includes error.

<2 Regarding the Generation of the Reference Signal>

Moreover, if the carriage is moving with acceleration or deceleration, then the ink does not land at an equal spacing when the pulse period T is divided into equal intervals.

Accordingly, in this embodiment, to make the ink land at an equal spacing, the acceleration of the carriage (that is, the acceleration of the nozzles) is calculated and a signal serving as a reference for the timing at which ink is ejected is generated based on the results of a plurality of detections by the encoder.

Figure 17A:
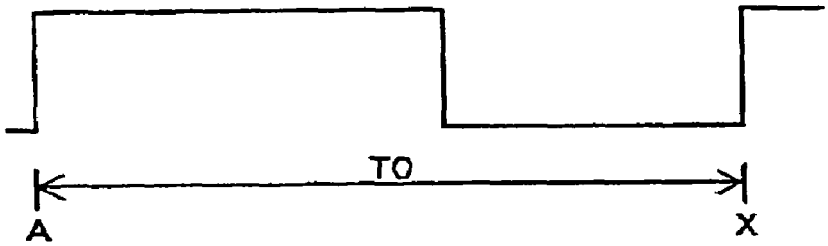
FIG. 17A shows the waveform of the output signal that is anticipated in the section A to X of FIG. 16.

FIG. 17A shows the waveform of the output signal expected in the section A to X of FIG. 16. It should be noted that as mentioned above, the period T0 of this output signal is calculated based on the acceleration of the carriage that is calculated from the results of a plurality of detections by the encoder.

Figure 17B:
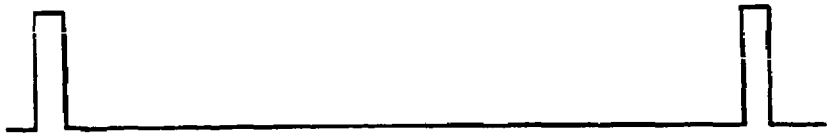
FIG. 17B shows the waveform of the reference signal in a case where the pulse period T0 has not been divided.

FIG. 17B shows the waveform of the reference signals in a case where the pulse period T0 is not segmented. The reference signals in this drawing are generated based on the rising edge of the linear encoder 51. That is, when the pulse period T0 is not segmented, the reference signals can be generated based on the rising edge of the linear encoder 51. Consequently, in this case, the acceleration of the carriage is not necessary to generate the reference signals. However, using these reference signals as a reference, ink is ejected at the timing of the delay amount m corresponding to the acceleration of the carriage.

Figure 17C:
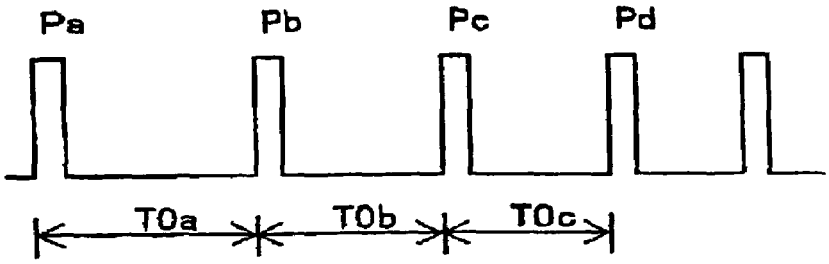
FIG. 17C shows the waveform of the reference signal in a case where the pulse period T0 has been divided into four segments.

FIG. 17C shows the waveform of the reference signals when the pulse period T0 is divided into four segments. In this figure, the velocity gradually grows faster because the carriage is accelerating, and therefore the intervals between the reference signals Pa to Pd gradually become shorter.

Here, the reference signal Pa is generated based on the rising edge of the linear encoder 51. Then the reference signal Pb is generated after a time T0*a* has passed from the reference signal Pa. The time T0*a* is obtained by calculating the velocity of the carriage that is expected between Pa and Pb based on the acceleration of the carriage. The acceleration of the carriage is detected in the same manner as described above. Furthermore, the times T0*b* and T0*c* are calculated in the same manner as the time T0*a*, that is, they are found based on the acceleration of the carriage. It is not particularly necessary to compute the time between the reference signal Pd and the next reference signal. This is because the reference signal after the reference signal Pd can be generated based on the rising edge of the linear encoder 51.

It should be noted that ink is ejected at a timing delayed with respect to each reference signal by the delay amount m. Here, the delay amount m is calculated in the same manner as described above.

In this embodiment, since the acceleration of the carriage is positive, the intervals between reference signals become short and the period of the timing of ink ejection also becomes short. On the other hand, when the acceleration of the carriage is negative (i.e., when the carriage is decelerating), the intervals between reference signals become long and the period of the timing of ink ejection becomes long.

As described above, if the delay amount and the reference signals of ink ejection are calculated based on the acceleration of the carriage (that is, the acceleration of the nozzles), then the ink can be made to land at target positions, and thus high-precision printing can be performed.

===Relationship Between the Arrangement of Nozzles and the Timing of Ejection===

<Regarding the Arrangement of Nozzles>

Figure 18:
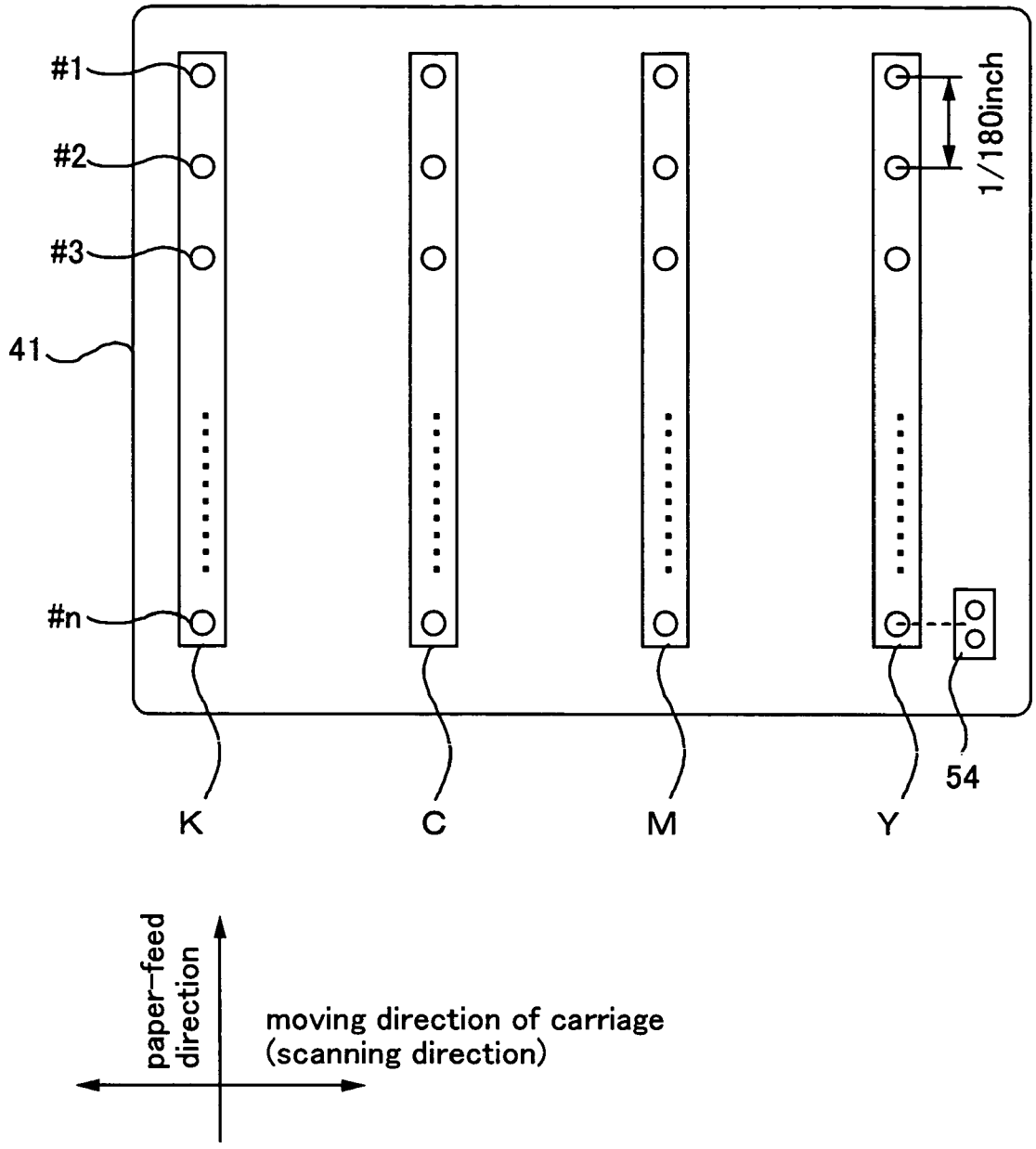
FIG. 18 is an explanatory diagram showing the arrangement of nozzles.

FIG. 18 is an explanatory diagram showing the arrangement of nozzles provided in the head 21 according to the present embodiment. In the bottom surface of the head 21 are formed: a black ink nozzle group K, a cyan ink nozzle group C, a magenta ink nozzle group M, and a yellow ink nozzle group Y. Each nozzle group is provided with a plurality of nozzles (180 nozzles in the present embodiment), which are ejection openings for ejecting ink of the respective colors.

The four nozzle groups are each provided at different positions in the scanning direction (i.e., the moving direction of the carriage). Therefore, the nozzles in one nozzle group are located at a different position in the scanning direction from the nozzles in another nozzle group.

It should be noted that the plurality of nozzles in each nozzle group are arranged in a row in the carrying direction at a predetermined interval ("nozzle pitch"). In the present embodiment, the nozzle pitch is 180 dpi (1/180 inch). The nozzles in each nozzle group are numbered (from #1 to #180), the number being smaller for nozzles on the downstream side. Regarding the position in the paper-feed direction of the above-described gap sensor 54, the gap sensor 54 is at substantially the same position as the nozzle #180, which is the most upstream nozzle.

<Regarding the Ink-Ejection Timing of Each Nozzle (1)>

Figure 19A:
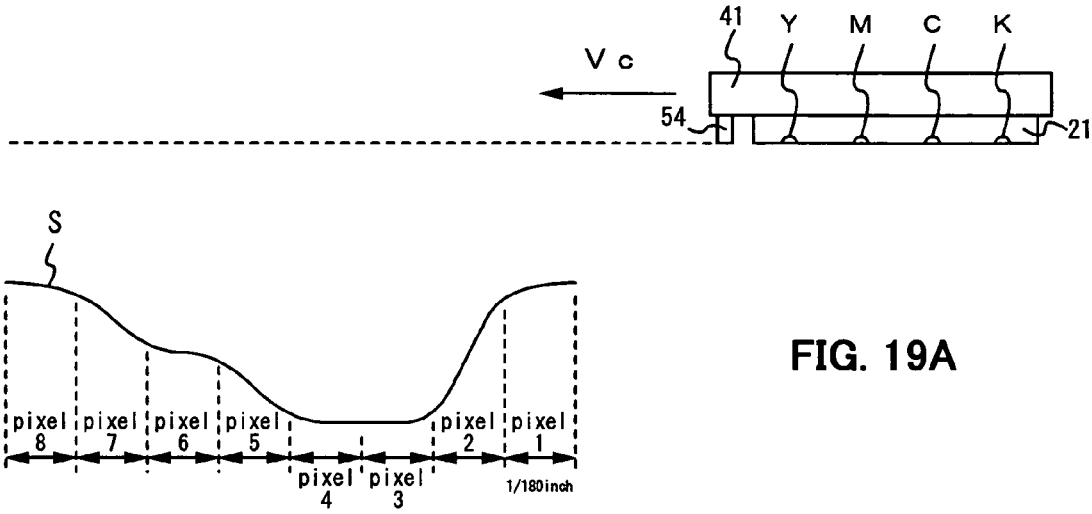
FIG. 19A is an explanatory diagram showing the positional relationship among nozzle groups according to the present embodiment.

FIG. 19A is an explanatory diagram showing the positional relationship among the nozzle groups according to the present embodiment. For the sake of simplification of description, the interval (distance) between adjacent nozzle groups is shown as being the same as the width of a single pixel. (In practice, the interval between adjacent nozzle groups is 16 pixels or 54 pixels.)

The carriage 41 moves from right to left in the figure at a moving velocity Vc. The head 21 causes ink to be ejected from the nozzles in each nozzle group and the ink to land on the paper S, thereby forming dots in the pixels on the paper S. The gap sensor 54 comes into opposition with the paper S before the nozzle groups in the head 21, and detects the distance PG up to the paper S.

Figure 19B:
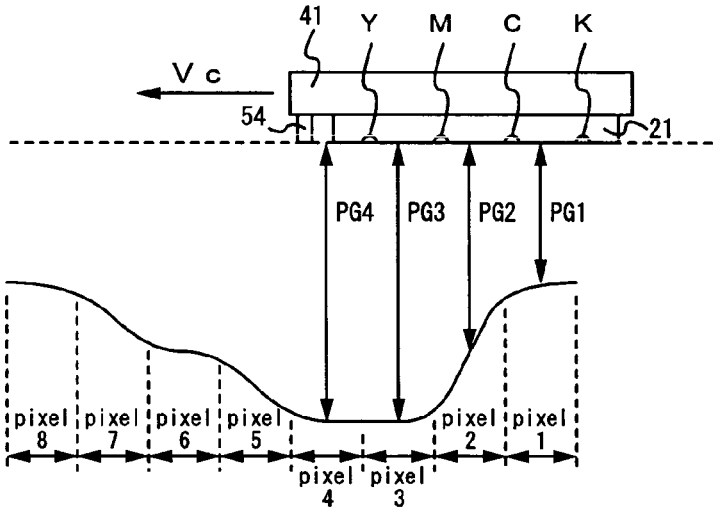
FIG. 19B is an explanatory diagram showing a state in which the nozzles in the nozzle group Y are at a reference position with respect to pixel 4.

FIG. 19B is an explanatory diagram showing a state in which the nozzles in the nozzle group Y are at a reference position with respect to pixel 4. Since the nozzle groups are located at different positions in the moving direction of the carriage (i.e., in the scanning direction), the nozzle groups comes into opposition with the paper at different positions. Further, since the interval (distance) between adjacent nozzle groups is set to be the same as the width of a single pixel, the nozzles in the magenta ink nozzle group M are at the reference position with respect to pixel 3, the nozzles in the cyan ink nozzle group C are at the reference position with respect to pixel 2, and the nozzles in the black ink nozzle group K are at the reference position with respect to pixel 1.

If ink is ejected from all of the nozzle groups at an ejection timing based on the latest detection result PG4 of the gap sensor 54, then the landing position of the ink droplets may deviate from the target landing position. For example, in FIG. 19B, the ink ejected from the yellow ink nozzle group Y will land precisely on pixel 4, which is the target landing position, when ink is ejected at an ejection timing based on the latest detection result PG4 of the gap sensor 54, but the ink ejected from the black ink nozzle group K will land on a position that is deviated more to the right in the figure than pixel 1, which is the target landing position, if ink is ejected at an ejection timing based on the latest detection result PG4 of the gap sensor 54. This is because the distance PG1 up to pixel 1 is shorter than the latest detection result PG4 of the gap sensor 54.

Accordingly, in the present embodiment, ink is ejected from the nozzles in each nozzle group based on distances PG detected at different positions such that ink droplets land on their respective target landing positions.

First, in the present embodiment, the CPU 61 makes the gap sensor 54 detect the distance PG up to the paper at different positions in the scanning direction. More specifically, the CPU 61 makes the gap sensor 54 detect the distance PG at the position of each pixel, and stores the detection results in the memory 65 in association with the positions of the pixels. It should be noted that the table in which the positions of the pixels are associated with the detection results of the distances PG is referred to as a "PG table".

The table in the left part of FIG. 20A is an explanatory diagram of the PG table. The PG table shown in FIG. 20A is for the state shown in FIG. 19B.

The CPU 61 calculates the ink-ejection timing for each nozzle group in accordance with the PG table stored in the memory 65. More specifically, in the state shown in FIG. 19B, the CPU 61 reads out the PG table as shown in FIG. 20A from the memory 65, and calculates the ink-ejection timing for the yellow ink nozzle group Y in accordance with the distance PG4 that is associated with pixel 4. In the same way, the ink-ejection timing for the magenta ink nozzle group M is calculated in accordance with the distance PG3 associated with pixel 3, and the ink-ejection timings of the other nozzle groups are calculated in the same way. It should be noted that as described above, the timing corresponding to the amount of delay is calculated for each nozzle group as the ink-ejection timing.

The CPU 61 then causes ink droplets to be ejected from the nozzles in each nozzle group at the ink-ejection timing calculated for each nozzle group. As a result, after arriving at the reference position shown in FIG. 19B, ink droplets are ejected from the nozzles in the yellow ink nozzle group Y (and the magenta ink nozzle group M) with a predetermined amount of delay, ink droplets are then ejected from the nozzles in the cyan ink nozzle group C, and ink droplets are ejected from the nozzles in the black ink nozzle group K. In this way, the ink droplets ejected from the nozzles in each nozzle group land on the pixels, which are their target landing positions.

It should be noted that while the carriage is moving, the CPU 61 updates the PG table whenever necessary. For example, the PG table of FIG. 20B is for a state in which the carriage has been moved from the state shown in FIG. 19B to the left by one pixel. The CPU 61 shifts the data to be read out by one pixel, and calculates the ink-ejection timing for each nozzle group.

<Regarding the Ink-ejection Timing of Each Nozzle (2)>

In the description above, the gap sensor 54 comes into opposition with the paper S before the nozzle groups in the head 21 and detects the distances PG to the paper S. However, the situation is different in bi-directional printing.

Figure 21:
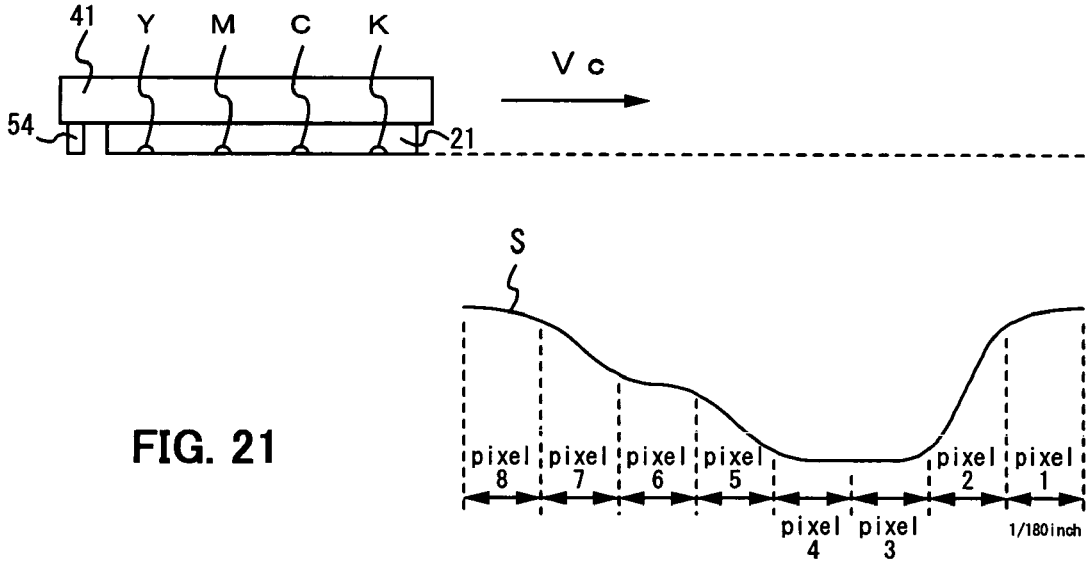
FIG. 21 is an explanatory diagram showing an example in which the nozzle groups come into opposition with the paper S before the gap sensor 54.

FIG. 21 is an explanatory diagram showing an example in which the nozzle groups come into opposition with the paper S before the gap sensor 54. In this example, the distance up to the paper at pixel 8 still has not been detected when, for example, the black ink nozzle group K has arrived at the reference position with respect to pixel 8, and therefore, it is not possible to calculate the ink-ejection timing.

In view of the above, the CPU 61 associates all of the detection results with their respective positions of pixels and stores this data in the memory 65 as a PG table while the carriage 41 is moving from right to left in the figure (see FIG. 19A). Then, when the carriage 41 is moving from left to right in the figure (see FIG. 21), the CPU 61 reads out the PG table stored in the memory to calculate the ink-ejection timing for each nozzle group.

In this way, the CPU 61 can calculate the ink-ejection timing for each nozzle group in accordance with the distance up to the paper for each nozzle group, even when the nozzle groups come into opposition with the paper S before the gap sensor 54.

<Regarding the Ink-ejection Timing of Each Nozzle (3)>

In the description above, it is assumed that the distance PG up to the paper is the same for all of the nozzles in the same nozzle group, and therefore, the ink-ejection timing for the nozzles in the same nozzle group is the same. This, however, is not a limitation. For example, the ink-ejection timing may be made to differ among nozzles in the same nozzle group based on different distances PG.

FIG. 22A through FIG. 22E are explanatory diagrams for describing how printing is carried out by feeding the paper at intervals of approximately ¼ inch. In the present embodiment, 180 pieces of nozzles are arranged in a row at a nozzle pitch of 1/180 inch (see FIG. 18), and therefore, the paper-feed amount during printing in this example is approximately ¼ of the length of one nozzle group. In this printing method, one print area is printed in four passes of the head. In the figures, the black sections inside the rectangles, which indicate the nozzle groups, indicate that the nozzles in those sections eject ink while moving.

Figure 22A:
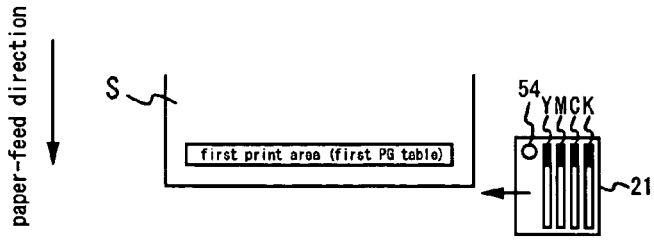
FIG. 22A through FIG. 22E are explanatory diagrams for describing how printing is carried out by feeding the paper at intervals of approximately ¼ inch.

FIG. 22A is an explanatory diagram for describing the first printing operation. First, the CPU 61 makes the carrying unit 10 carry the paper S in the paper-feed direction to position the paper S and the head 21 in the positional relationship shown in FIG. 22A. The CPU 61 then drives the CR motor 42 to move the carriage from right to left (i.e., in the forward direction), thus making the head 21 move in the direction shown by the arrow in the figure. In this case, the gap sensor 54 can detect the distance up to the paper S before the nozzle groups print the first print area. Therefore, in accordance with the method described above (see FIG. 20A and FIG. 20B), the CPU 61 creates a first PG table in which the positions of the pixels on the paper S (i.e., the positions in the moving direction of the carriage) and the detection results of the gap sensor 54 are associate with one another. Based on this first PG table, ink is ejected from ¼ of the nozzles in each nozzle group that are on the upstream side in the paper-feed direction (i.e., from nozzle #136 through nozzle #180). In this way, the first print area is printed on the paper S.

Figure 22B:
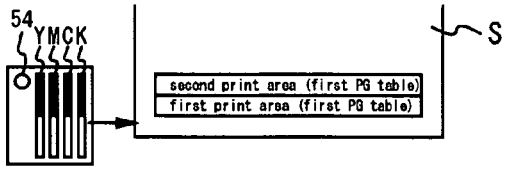

FIG. 22B is an explanatory diagram for describing the second printing operation. After the first print operation, the CPU 61 makes the carrying unit carry the paper S for approximately ¼ inch to position the paper S and the head 21 in the positional relationship shown in FIG. 22B. Then, when the carriage moves from left to right (i.e., in the return direction), the CPU 61 causes the ink to be ejected from half of the nozzles in each nozzle group that are on the upstream side in the paper-feed direction (i.e., from nozzle #91 through nozzle #180) based on the first PG table that has already been stored in the memory. In this way, the first and second print areas are printed on the paper S.

Figure 22C:
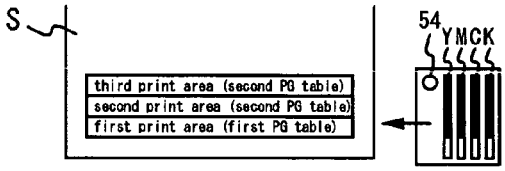

FIG. 22C is an explanatory diagram for describing the third printing operation. In this third printing operation, the gap sensor 54 can detect the distance up to the paper S before the nozzle groups print the first print area. Therefore, the CPU 61 creates a second PG table in which the positions of the pixels on the paper S (i.e., the positions in the moving direction of the carriage) and the detection results of the gap sensor 54 are associate with one another. Based on this second PG table, ink is ejected from ¼ of the nozzles in each nozzle group that are on the upstream side in the paper-feed direction (i.e., from nozzle #136 through nozzle #180). On the other hand, since the distances PG up to the paper in the first print area have already been detected during the first printing operation, the ink-ejection timings for the nozzles that print the first print area (i.e., nozzle #46 through nozzle #90) are calculated based on the first PG table. As regards the ink-ejection timings for the nozzles that print the second print area (i.e., nozzle #91 through nozzle #135), either the first PG table or the second PG table may be used for calculation. It is, however, preferable to use the second PG table in consideration of the storage area of the memory described further below.

Figure 22D:
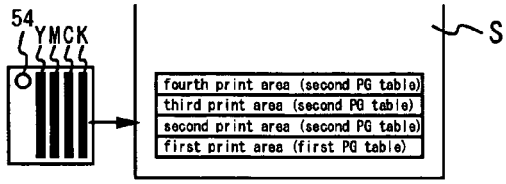

FIG. 22D is an explanatory diagram for describing the fourth printing operation. As shown in the figure, the ink-ejection timings for the nozzles that print the first print area (i.e., nozzle #1 through nozzle #45) are calculated based on the first PG table stored in the memory. On the other hand, the ink-ejection timings for the nozzles that print the second through fourth print areas (i.e., nozzle #46 through nozzle #180) are calculated based on the second PG table stored in the memory. It should be noted that when the fourth printing operation is finished, printing of the first print area is completed.

Figure 22E:
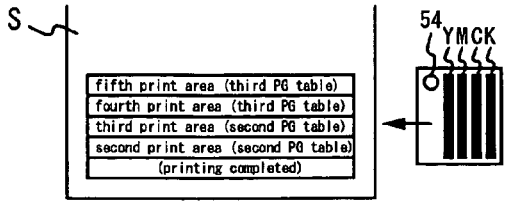

FIG. 22E is an explanatory diagram for describing the fifth printing operation. During the fifth printing operation, the CPU 61 creates a third PG table while calculating the ink-ejection timings for printing the fourth and fifth print areas based on the third PG table. In this fifth printing operation, the first PG table is no longer used. Therefore, in order to use the memory capacity efficiently, the third PG table is stored in the storage area of the memory where the first PG table was stored such that the third PG table overwrites the first PG table.

In the present embodiment, the gap sensor 54 is provided on the upstream side in the paper-feed direction, and therefore, it is possible to create, before a certain print area is printed, a PG table that is used for calculating the ink-ejection timing for printing that print area. If the gap sensor 54 is provided further downstream in the paper-feed direction than nozzle #1, then it would not be possible to create the first PG table when printing the first print area.

Further, in the present embodiment, the ink-ejection timings may differ among nozzles that belong to the same nozzle group. For example, in FIG. 22E, the ink-ejection timing for nozzle #1 is calculated based on the second PG table, whereas the ink-ejection timing for nozzle #180 is calculated based on the third PG table. In this way, the ink droplets ejected from each of the nozzles will land precisely on their target landing positions.

===Configuration of the Computer System etc.===

Next, an embodiment of a computer system, a computer program, and a storage medium storing the computer program, which are examples of the embodiment according to the present invention, are described with reference to the drawings.

Figure 23:
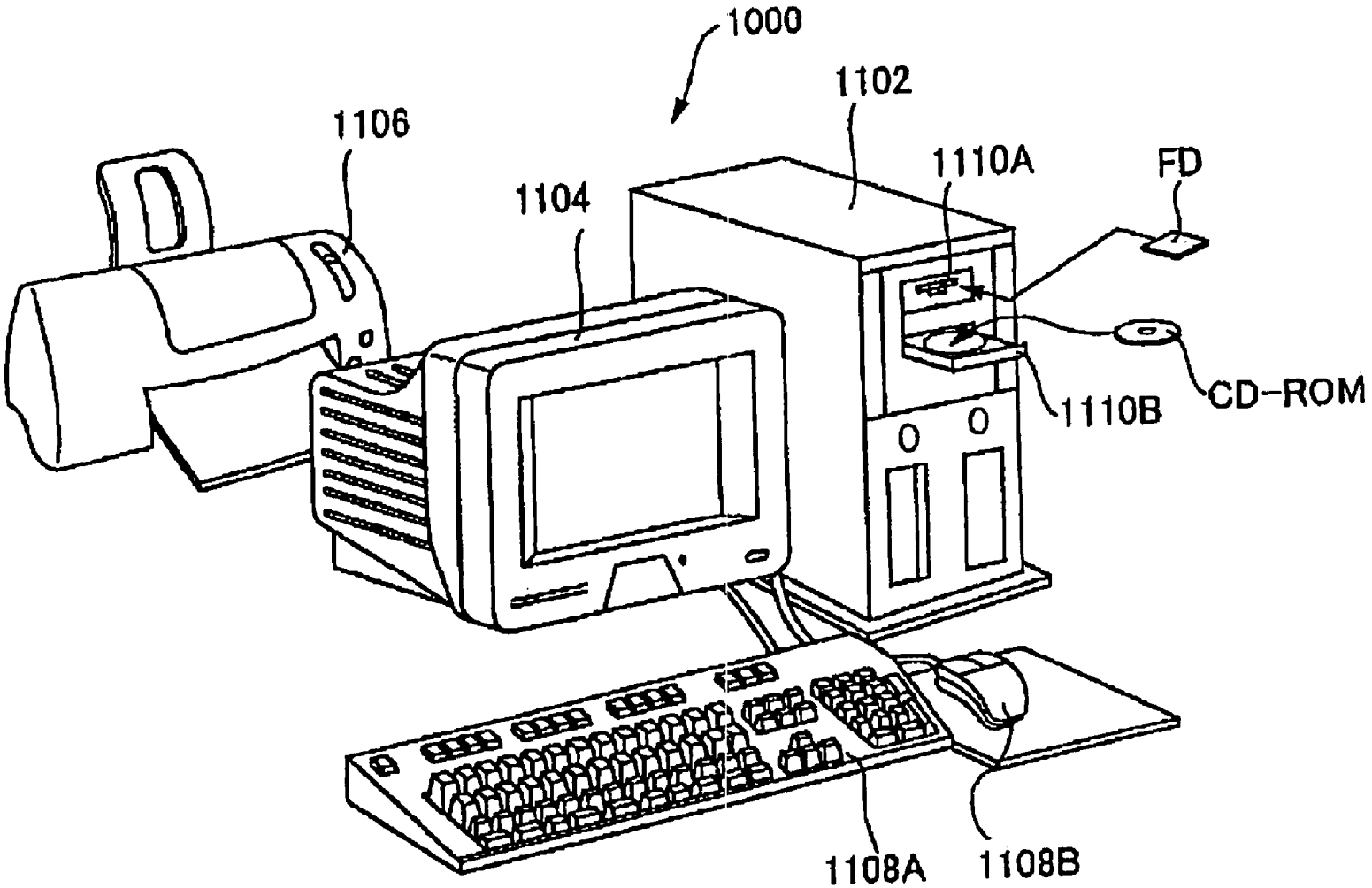
FIG. 23 is an explanatory diagram showing the external configuration of the computer system.

FIG. 23 is an explanatory drawing showing the external structure of the computer system. A computer system 1000 is provided with a main computer unit 1102, a display device 1104, a printer 1106, an input device 1108, and a reading device 1110. In this embodiment, the main computer unit 1102 is accommodated within a mini-tower type housing; however, this is not a limitation. A CRT (cathode ray tube), plasma display, or liquid crystal display device, for example, is generally used as the display device 1104, but this is not a limitation. The printer 1106 is the printer described above. In this embodiment, the input device 1108 is a keyboard 1108A and a mouse 1108B, but it is not limited to these. In this embodiment, a flexible disk drive device 1110A and a CD-ROM drive device 1110B are used as the reading device 1110, but the reading device 1110 is not limited to these, and it may also be a MO (magnet optical) disk drive device or a DVD (digital versatile disk), for example.

Figure 24:
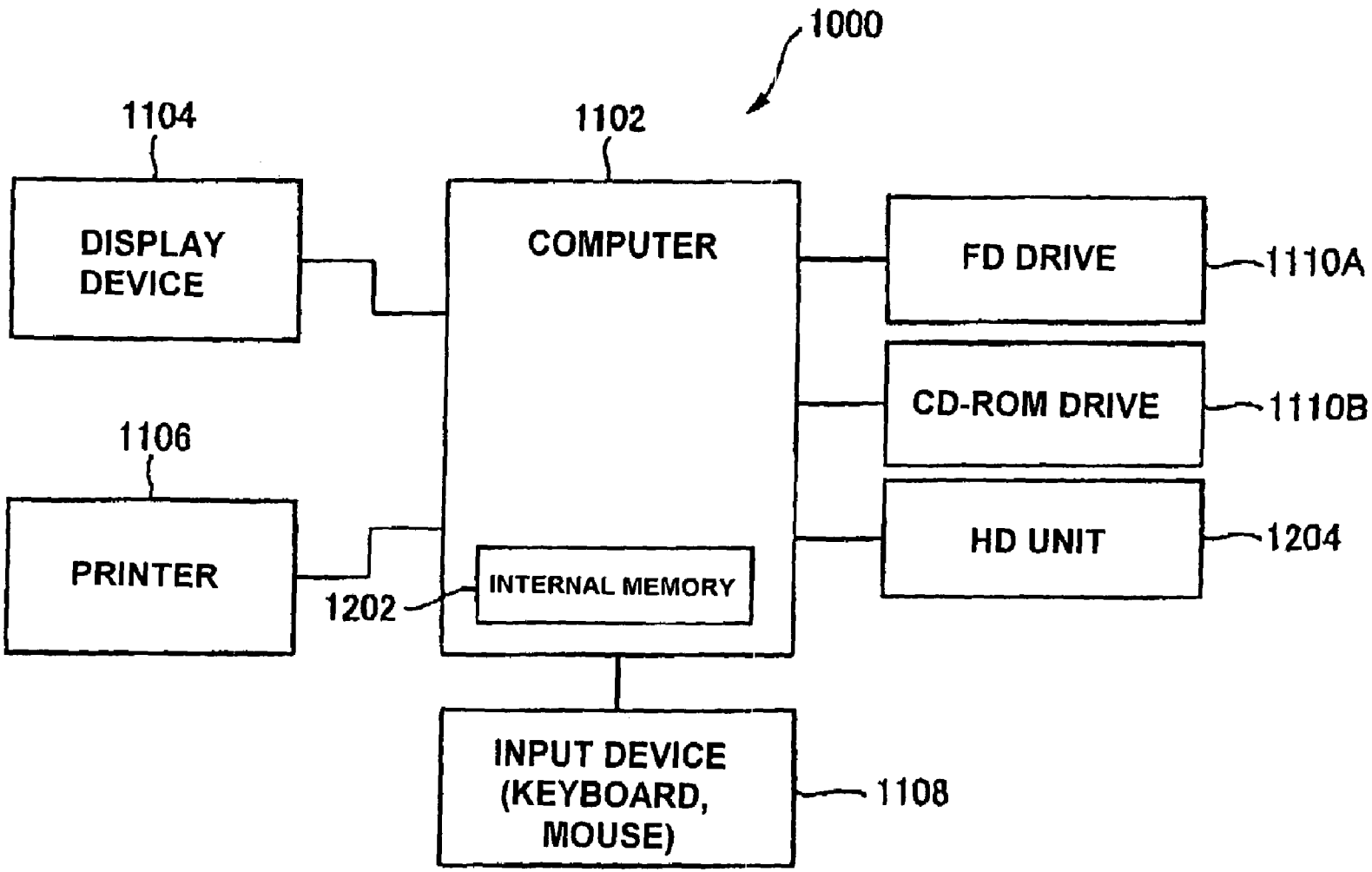
FIG. 24 is a block diagram showing the configuration of the computer system.

FIG. 24 is a block diagram showing the configuration of the computer system shown in FIG. 23. An internal memory 1202 such as a RAM within the housing accommodating the main computer unit 1102 and, also, an external memory such as a hard disk drive unit 1204 are provided. A computer program for controlling the operation of the above printer is stored on a flexible disk FD or a CD-ROM, for example, which are storage media, and is read by the reading device 1110. The computer program may also be downloaded onto the computer system 1000 via a communications line such as the Internet.

In the above description, an example was described in which the computer system is constituted by connecting the printer 1106 to the main computer unit 1102, the display device 1104, the input device 1108, and the reading device 1110; however, this is not a limitation. For example, the computer system can be made of the main computer unit 1102 and the printer 1106, or the computer system does not have to be provided with any one of the display device 1104, the input device 1108, and the reading device 1110. It is also possible for the printer 1106 to have some of the functions or mechanisms of the main computer unit 1102, the display device 1104, the input device 1108, and the reading device 1110. As an example, the printer 1106 may be configured so as to have an image processing section for carrying out image processing, a display section for carrying out various types of displays, and a recording media attachment/detachment section to and from which recording media storing image data captured by a digital camera or the like are inserted and taken out.

In the embodiment described above, it is also possible for the computer program for controlling the printer to be incorporated in the memory 65 of the control unit 60. Also, the control unit 60 may execute this computer program so as to achieve the operations of the printer in the embodiment described above.

As an overall system, the computer system that is thus achieved is superior to conventional systems.

===Other Embodiments===

In the foregoing, a printer, for example, according to the invention was described based on an embodiment thereof. However, the foregoing embodiment is for the purpose of elucidating the present invention and is not to be interpreted as limiting the present invention. The invention can of course be altered and improved without departing from the gist thereof and includes functional equivalents. In particular, the embodiments mentioned below are also included in the printing apparatus according to the invention.

<Regarding the Region in which Timing Control is Performed>

According to the embodiment described above, the delay amount m is obtained and the timing of ink ejection is delayed regardless of whether the carriage is in the acceleration and deceleration regions or in the constant velocity region. However, this is not a limitation. For example, it is also possible to find the delay amount m and control the timing of ink ejection only when the carriage is accelerating or decelerating (or only when it is accelerating and decelerating). This is because in the constant velocity region, the variation in landing position due to changes in the velocity of the carriage is small, and therefore, there are instances in which it can be ignored.

<Regarding Detection of the Distance PG>

According to the embodiment described above, the distance PG from the nozzles of the head 21 to the paper is detected by the gap sensor 54. The detection of the distance PG from the nozzles to the paper, however, is not limited to detection using the gap sensor 54.

For example, if information about the type of paper, which is the medium to be printed, is obtained in advance, then the paper thickness is known from the type of the paper, and thus the distance PG from the nozzles to the paper can be detected. In this case, information about the relationship between the paper type and the distance PG can be stored in the memory 65 in beforehand as a table. Also, in this case, the printer or the computer connected to the printer can have input means for receiving input on the type of paper to be printed. For example, the type of paper to be printed is input by the user through a user interface, and based on the table stored in the memory, the computer or the printer detects the distance PG from the type of the paper.

Further, if the printer has a plurality of trays for accommodating paper, which is the medium to be printed, then information about the paper that is accommodated can be obtained from the information about the trays, and thus based on the information about the trays, it is possible to detect the distance PG from the nozzles to the paper. In this case, information about the paper accommodated in the trays can be stored in the memory 65.

<Regarding Detection of the Velocity of the Carriage>

According to the embodiment described above, the velocity of the carriage was detected by the linear encoder 51. However, the detection of the carriage velocity is not limited to detection using the linear encoder 51. For example, it is also possible to detect the velocity of the carriage based on drive commands given to the CR motor drive from the CPU 61 or the DC unit 66.

<Regarding Detection of the Acceleration of the Carriage>

According to the embodiment described above, the acceleration of the carriage was detected by the linear encoder 51. However, detection of the carriage acceleration is not limited to detection using the linear encoder 51. For example, it is also possible to detect the velocity of the carriage based on drive commands given to the CR motor drive from the CPU 61 or the DC unit 66.

<Regarding Detection of the Ink Velocity Vi>

According to the embodiment described above, the ink velocity Vi was detected by the amount of ink that is ejected. However, the detection of the ink velocity is not limited to this. For example, since the viscosity of ink changes according to changes in the environment temperature and this also alters the velocity Vi of the ink, it is also possible to detect the velocity of the ink based on the temperature. In this case, information about the relationship between the ink velocity Vi and the temperature can be stored in the memory 65 as a table.

Also, if the amount of ejected ink differs depending on the print mode, then the ink velocity vi can also be detected based on the print mode that is selected by the user through the interface.

<Regarding the Gap Sensor>

According to the embodiment described above, the gap sensor 54 has one light emitting section and two light-receiving sections, and with this configuration, detects the distance PG from the nozzles to the paper S. However, the configuration of the gap sensor is not limited to this. For example, a sensor with two light emitting sections and one light-receiving section can also detect the distance PG from the nozzles to the paper S by switching between the lights emitted by the two light emitting sections.

Also, in the foregoing embodiment, among the light emitted from the light emitting section, only the light that was reflected regularly at the paper S was detected at the light-receiving sections; however, light that is scattered by the paper S may also be detected.

Furthermore, it is of course also possible to detect the distance PG from the nozzles to the paper S through other methods.

<Regarding the Nozzles>

According to the embodiment described above, the nozzles were provided in the head 21 and the head 21 was provided on the carriage 41, and thus the nozzles were provided integrally with the carriage 41. However, the configuration of the nozzles or the head 21 is not limited to this. For example, the nozzles or the head may be provided integrally with the cartridge 48 (see FIG. 2) and be detachable with respect to the carriage 41.

<Regarding the Method for Ejecting Ink>

In the foregoing embodiment, piezo elements were used for the ejection of ink. However, the element for ejecting ink is not limited to this. For example, the ink can be boiled by a heater and ejected by means of bubbles. Also, ink droplets may be ejected by other elements.

According to the printing apparatus of a first aspect of the present invention, the timing at which ink is ejected can be controlled taking into account the distance from the ink ejection section to the medium to be printed. Thus, printing can be carried out with higher precision than was the case conventionally.

According to the printing apparatus of a second aspect of the present invention, the timing of ink ejection can be kept from becoming faster than the timing serving as the reference for the ejection of ink due to the velocity at which the nozzles are moved.

According to the printing apparatus of a third aspect of the present invention, the timing at which ink is ejected can be controlled taking into account the acceleration of the ink ejection section. Thus, printing can be carried out with higher precision than was the case conventionally.

According to the printing apparatus of a fourth aspect of the present invention, the timing of ink ejection is controlled based on a plurality of detected signals, and thus discrepancies in the positions where ink lands can be reduced even if the velocities that are detected include error.

What is claimed is:

1. A printing apparatus for printing on a medium to be printed, comprising:

a carry mechanism that carries the medium to be printed in a carrying direction;

a plurality of ink ejection sections for intermittently ejecting ink while moving, said plurality of ink ejection sections being arranged in the carrying direction; and a sensor that detects a distance to said medium to be printed, while moving with said ink ejection sections;

wherein said printing apparatus:

alternately repeats an ink ejection operation by said plurality of ink ejection sections, and a carrying operation to carry the medium to be printed by a carry amount shorter than a length of said plurality of ink ejection sections in the carrying direction;

stores a detection result of said sensor in a first ejection operation as a first result, and stores a detection result of said sensor in a second ejection operation, different from the first ejection operation, as a second result; and in a certain ejection operation, controls a timing of ejection of the ink from a certain ejection section, of said plurality of ink ejection sections, based on the first result, and controls a timing of ejection of the ink from another ink ejection section, of said plurality of ink ejection sections, based on the second result.

2. A printing apparatus according to claim 1, wherein:

when a velocity at which said ink ejection section moves is slower than a velocity serving as a reference, said ink is ejected at a timing that is delayed compared to the timing of ejection of said ink for when said ink ejection section is moving at said velocity serving as the reference.

3. A printing apparatus according to claim 2, wherein:

the slower the velocity at which said ink ejection section moves, the more said timing at which the ink is ejected is delayed.

4. A printing apparatus according to claim 1, wherein: the smaller said distance is, the more said timing at which the ink is ejected is delayed.

5. A printing apparatus according to claim 1, wherein:

said distance is detected based on information about a type of the medium to be printed or on information about a tray accommodating the medium to be printed.

6. A printing apparatus according to claim 1, wherein:

the detection of said distance is performed at a plurality of positions in a direction in which said ink ejection section moves; and said timing of ejection of said ink is controlled for each area provided in a scanning direction.

7. A printing apparatus according to claim 1, wherein:

a plurality of the ink ejecting sections are provided at different positions in the direction in which said ink ejection sections move;

the detection of said distance is performed at different positions in the direction in which said ink ejection sections move; and said timing of ejection of said ink for each of said ink ejection sections is controlled based on said distance that has been detected respectively at different positions.

8. A printing apparatus according to claim 1, wherein:

a velocity of said ink that is ejected is detected; and said timing of ejection of said ink from said ink ejection section is controlled based on the velocity of said ink that has been detected and said distance that has been detected.

9. A printing apparatus according to claim 8, wherein: the velocity of said ink is detected based on an amount of said ink that is ejected.

10. A printing apparatus according to claim 8, wherein: the velocity of said ink is detected based on a temperature.

11. A printing apparatus according to claim 8, wherein: the velocity of said ink is detected based on a print mode.

12. A printing apparatus according to claim 1, wherein: the faster the velocity of said ink that is ejected is, the more said timing at which the ink is ejected is delayed.

13. A printing method for printing on a medium to be printed, comprising:

carrying the medium to be printed in a carrying direction;

intermittently ejecting ink from a plurality of moving ink ejection sections, wherein the ink ejection sections are arranged in the carrying direction;

detecting a distance from the ink ejection sections to the medium to be printed;

alternately repeating an ink ejection operation by the plurality of ink ejection sections, and a carrying operation carrying the medium to be printed by a carry amount shorter than a length of the plurality of ink ejection sections in the carrying direction;

storing the detected distance from the ink ejection sections to the medium to be printed in a first ejection operation as a first result, and storing the detected distance from the ink ejection sections to the medium to be printed in a section ejection operation, different from the first ejection operation, as a second result;

in a certain ejection operation, controlling a timing of ejection of ink from a certain ink ejection section, of the plurality of ink ejection sections, based on the first result, and controlling a timing of direction of the ink from another ink ejection section, of the plurality of ink ejection sections, based on the second result.

14. A storage medium comprising a memory for storing a program, wherein said program enables a printing apparatus for printing on a medium to be printed to perform the steps of:

carrying the medium to be printed in a carrying direction;

intermittently ejecting ink from a plurality of moving ink ejection sections, wherein the ink ejection sections are arranged in the carrying direction;

detecting a distance from the ink ejection sections to the medium to be printed;

alternately repeating an ink ejection operation by the plurality of ink ejection sections, and a carrying operation carrying the medium to be printed by a carry amount shorter than a length of the plurality of ink ejection sections in the carrying direction;

storing the detected distance from the ink ejection sections to the medium to be printed in a first ejection operation as a first result, and storing the detected distance from the ink ejection sections to the medium to be printed in a section ejection operation, different from the first ejection operation, as a second result;

in a certain ejection operation, controlling a timing of ejection of ink from a certain ink ejection section, of the plurality of ink ejection sections, based on the first result, and controlling a timing of ejection of the ink from another ink ejection section, of the plurality of ink ejection sections, based on the second result.

15. A computer system comprising:

a computer; and a printing apparatus, connected to said computer, for printing on a medium to be printed;

wherein said printing apparatus comprises:

a carry mechanism that carries the medium to be printed in a carrying direction;

a plurality of ink ejection sections for intermittently ejecting ink while moving, said plurality of ink ejection sections being arranged in the carrying direction;

a sensor that detects a distance from said ink ejection sections to said medium to be printed, while moving with said ink ejection sections; and wherein said printing apparatus:

alternately repeats an ink ejection operation by said plurality of ink ejection sections, and a carrying operation to carry the medium to be printed by a carry amount shorter than a length of said plurality of ink ejection sections in the carrying direction;

stores a detection result of said sensor in a first ejection operation as a first result, and stores a detection result of said sensor in a second ejection operation, different from the first ejection operation, as a second result; and in a certain ejection operation, controls a timing of ejection of ink from a certain ink ejection section, of said plurality of ink ejection sections, based on the first result, and controls a timing of ejection of the ink from another ink ejection section, of said plurality of ink ejection sections, based on the second result.

* * * * *